US008827483B2

(12) United States Patent
Dixon et al.

(10) Patent No.: US 8,827,483 B2
(45) Date of Patent: Sep. 9, 2014

(54) LIGHT FOR A POWER TOOL AND METHOD OF ILLUMINATING A WORKPIECE

(75) Inventors: Eva J. Dixon, Columbia, MD (US); Daniel L. Krout, Abungdon, MD (US); Robert G. Kusmierski, York, PA (US); Stephen P. Osborne, Baltimore, MD (US); Amanda Miller, Joppa, MD (US); Jeffrey Delcamp, Baltimore, MD (US); Corey G. Robertson, Felton, PA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 13/616,686

(22) Filed: Sep. 14, 2012

(65) Prior Publication Data

US 2013/0003359 A1 Jan. 3, 2013

Related U.S. Application Data

(63) Continuation of application No. 12/379,585, filed on Feb. 25, 2009, now Pat. No. 8,328,381.

(51) Int. Cl.
*B25B 23/18* (2006.01)

(52) U.S. Cl.
USPC ..... 362/119; 362/109

(58) Field of Classification Search
USPC ..... 362/109, 119, 120
See application file for complete search history.

(56) References Cited

U.S. PATENT DOCUMENTS

| | | | |
|---|---|---|---|
| 1,565,566 | A | 12/1925 | Hartley |
| 2,038,911 | A | 4/1936 | Stutz et al. |
| 2,242,536 | A | 5/1941 | Montgomery |
| 2,310,166 | A | 2/1943 | Way |
| 2,517,882 | A | 8/1950 | Johnson |
| 2,525,414 | A | 10/1950 | Kleinschmidt |

(Continued)

FOREIGN PATENT DOCUMENTS

| | | | |
|---|---|---|---|
| DE | 1410234 | U | 5/1937 |
| DE | 689848 | C | 4/1940 |

(Continued)

OTHER PUBLICATIONS

"DB1ODL 10.8 Volt Lithium Ion Micro Driver Drill," Hitachi Power Tools, Hitachi Koki USA, Ltd.; internet: http://www.hitachipowertools.com/store_item.php?iID=611&arrPath=1,2,22,p611, p. 1-3.

(Continued)

*Primary Examiner* — Y My Quach Lee
(74) *Attorney, Agent, or Firm* — Scott B. Markow

(57) ABSTRACT

A power tool including a end effector rotatable with respect to the housing, a collar rotatable with respect to the housing, a printed circuit board (PCB) rotatably fixed with respect to the housing, and a light element operatively connected to the PCB and adjacent to the end effector and in a recess of the collar and located to illuminate a workpiece machined by the power tool. A method of providing light for a workpiece being machined by a power tool including locating lighting elements around a spindle of a power tool, aligning the lighting elements to shine light on a workpiece being machined by the power tool, operatively connecting the lighting elements to a PCB, containing and supporting the PCB with a guide, supporting wires configured to provide power to the PCB with the guide, locating the lighting elements, PCB and guide in a rotatable collar, and preventing the lighting elements, PCB and guide from rotating when the collar rotates.

18 Claims, 17 Drawing Sheets

(56) References Cited

U.S. PATENT DOCUMENTS

| | | | |
|---|---|---|---|
| 2,525,588 | A | 10/1950 | Cameron et al. |
| 2,702,649 | A | 2/1955 | Neilson |
| 2,730,263 | A | 1/1956 | Neilson |
| 2,736,792 | A | 2/1956 | Freeland |
| 2,773,974 | A | 12/1956 | Markett |
| 2,852,051 | A | 9/1958 | Bickner |
| 2,855,675 | A | 10/1958 | Kolthoff et al. |
| 2,855,679 | A | 10/1958 | Gibble |
| 3,109,238 | A | 11/1963 | Marks |
| 3,144,584 | A | 8/1964 | La Fiandra |
| 3,393,309 | A | 7/1968 | Leach et al. |
| 3,499,226 | A | 3/1970 | Hopkins |
| 2,806,492 | A | 2/1971 | Jugler |
| 3,561,462 | A | 2/1971 | Jugler |
| 3,595,132 | A | 7/1971 | Thacker |
| 3,603,782 | A | 9/1971 | Wortmann |
| 3,656,727 | A | 4/1972 | Greenlee |
| 3,681,627 | A | 8/1972 | Murry et al. |
| 3,729,658 | A | 4/1973 | Voitov |
| 3,919,541 | A | 11/1975 | Chao |
| 3,977,278 | A | 8/1976 | Jackson |
| 3,983,976 | A | 10/1976 | Taylor |
| 4,078,869 | A | 3/1978 | Honeycutt |
| 4,089,031 | A | 5/1978 | Stevens |
| 4,131,203 | A | 12/1978 | Bridges |
| 4,133,507 | A | 1/1979 | Chervenak |
| 4,160,570 | A | 7/1979 | Bridges |
| 4,246,506 | A | 1/1981 | Vartanian et al. |
| 4,330,274 | A | 5/1982 | Friedman et al. |
| 4,399,226 | A | 8/1983 | Danielson et al. |
| 4,429,463 | A | 2/1984 | Angell |
| 4,480,295 | A | 10/1984 | Shuster |
| 4,480,301 | A | 10/1984 | Pfaff et al. |
| 4,498,868 | A | 2/1985 | Schuss |
| 4,536,000 | A | 8/1985 | Rohm |
| 4,540,318 | A | 9/1985 | Hornung et al. |
| 4,611,716 | A | 9/1986 | Sorlien |
| 4,648,610 | A | 3/1987 | Hegyi |
| 4,678,922 | A | 7/1987 | Leininger |
| 4,703,850 | A | 11/1987 | Walker |
| 4,809,426 | A | 3/1989 | Takeuchi et al. |
| 4,833,782 | A | 5/1989 | Smith |
| 4,839,777 | A | 6/1989 | Janko et al. |
| 4,899,971 | A | 2/1990 | Elkin |
| 4,930,628 | A | 6/1990 | Bridges |
| 5,003,434 | A | 3/1991 | Gonser et al. |
| 5,061,885 | A | 10/1991 | Fukuhara |
| 5,068,652 | A | 11/1991 | Kobayashi |
| 5,133,455 | A | 7/1992 | Chow |
| 5,158,354 | A | 10/1992 | Simonin |
| 5,166,225 | A | 11/1992 | Asanuma et al. |
| 5,169,225 | A | 12/1992 | Palm |
| 5,267,129 | A | 11/1993 | Anderson |
| 5,276,595 | A | 1/1994 | Patrie |
| 5,313,527 | A | 5/1994 | Guberman et al. |
| 5,319,527 | A | 6/1994 | Murphy et al. |
| 5,406,300 | A | 4/1995 | Tokimoto et al. |
| 5,412,476 | A | 5/1995 | Marantette |
| 5,412,546 | A | 5/1995 | Huang |
| 5,427,002 | A | 6/1995 | Edman |
| 5,473,519 | A | 12/1995 | McCallops et al. |
| 5,525,842 | A | 6/1996 | Leininger |
| 5,538,423 | A | 7/1996 | Coss et al. |
| 5,543,679 | A | 8/1996 | Morino et al. |
| 5,628,556 | A | 5/1997 | Hrabar et al. |
| 5,637,973 | A | 6/1997 | Hirai et al. |
| D380,952 | S | 7/1997 | Kim |
| 5,713,656 | A | 2/1998 | Lin |
| 5,720,542 | A | 2/1998 | Birge, Jr. et al. |
| 5,770,936 | A | 6/1998 | Hirai et al. |
| 5,793,130 | A | 8/1998 | Anderson |
| 5,797,670 | A | 8/1998 | Snoke et al. |
| 5,798,622 | A | 8/1998 | Hirai et al. |
| 5,801,454 | A | 9/1998 | Leininger |
| 5,818,188 | A | 10/1998 | Hirai et al. |
| 5,845,986 | A | 12/1998 | Breen |
| 5,873,647 | A | 2/1999 | Kurtz et al. |
| 5,913,596 | A | 6/1999 | Lin |
| 5,924,615 | A | 7/1999 | McGarrah |
| 5,970,616 | A | 10/1999 | Wahl et al. |
| 5,980,077 | A | 11/1999 | Shiao |
| 5,982,059 | A | 11/1999 | Anderson |
| 6,022,121 | A | 2/2000 | Lin |
| 6,028,694 | A | 2/2000 | Schmidt |
| 6,033,082 | A | 3/2000 | Lin |
| 6,033,087 | A | 3/2000 | Shozo et al. |
| 6,036,332 | A | 3/2000 | Antal |
| 6,050,698 | A | 4/2000 | Lee |
| 6,050,759 | A | 4/2000 | Bone |
| 6,067,714 | A | 5/2000 | Taylor et al. |
| 6,086,217 | A | 7/2000 | Jau |
| 6,095,659 | A | 8/2000 | Hsu |
| RE36,917 | E | 10/2000 | Leininger |
| 6,126,295 | A | 10/2000 | Hillinger |
| 6,135,608 | A | 10/2000 | Lin |
| 6,145,995 | A | 11/2000 | Hung |
| 6,161,256 | A | 12/2000 | Quiring et al. |
| 6,168,287 | B1 | 1/2001 | Liu |
| 6,168,301 | B1 | 1/2001 | Martinez et al. |
| 6,178,081 | B1 | 1/2001 | Armond et al. |
| 6,179,433 | B1 | 1/2001 | Shiao |
| 6,183,103 | B1 | 2/2001 | Hillinger |
| 6,206,538 | B1 | 3/2001 | Lemoine |
| 6,213,620 | B1 | 4/2001 | Huang |
| 6,224,229 | B1 | 5/2001 | Lin |
| 6,237,767 | B1 | 5/2001 | Lee |
| 6,238,058 | B1 | 5/2001 | Lin |
| 6,243,240 | B1 | 6/2001 | Ozue et al. |
| 6,257,077 | B1 | 7/2001 | Patterson |
| 6,260,979 | B1 | 7/2001 | Lin |
| 6,260,980 | B1 | 7/2001 | Ping |
| 6,280,047 | B1 | 8/2001 | Chen |
| 6,283,607 | B1 | 9/2001 | Lin |
| D449,506 | S | 10/2001 | Haung |
| 6,318,874 | B1 | 11/2001 | Matsunaga |
| 6,318,875 | B1 | 11/2001 | Hrabar et al. |
| 6,322,177 | B1 | 11/2001 | Vasudeva |
| 6,364,033 | B1 | 4/2002 | Hung et al. |
| 6,401,996 | B1 | 6/2002 | Thorn et al. |
| 6,443,675 | B1 | 9/2002 | Kopras et al. |
| 6,454,429 | B1 | 9/2002 | Liao |
| 6,467,577 | B1 | 10/2002 | Charlebois, Jr. |
| 6,478,442 | B2 | 11/2002 | Chen |
| 6,494,590 | B1 | 12/2002 | Paganini et al. |
| 6,497,494 | B1 | 12/2002 | Lin |
| 6,501,199 | B2 | 12/2002 | Hung |
| 6,502,947 | B2 | 1/2003 | Matsumoto et al. |
| 6,502,949 | B1 | 1/2003 | Horiyama et al. |
| 6,511,201 | B1 | 1/2003 | Elrod |
| 6,565,227 | B1 | 5/2003 | Davis |
| 6,575,590 | B1 | 6/2003 | Wadsworth |
| 6,616,295 | B2 | 9/2003 | Sako et al. |
| 6,617,737 | B1 | 9/2003 | Minalga et al. |
| 6,622,537 | B2 | 9/2003 | Rodriguez |
| 6,644,825 | B2 | 11/2003 | Lin |
| 6,663,260 | B1 | 12/2003 | Tieszen |
| 6,694,631 | B2 | 2/2004 | Bone et al. |
| 6,713,905 | B2 | 3/2004 | Hirschburger et al. |
| 6,725,945 | B2 | 4/2004 | Sugimoto et al. |
| 6,729,743 | B2 | 5/2004 | Gillette |
| D493,345 | S | 7/2004 | Allison |
| 6,803,683 | B2 | 10/2004 | Bone et al. |
| 6,810,596 | B2 | 11/2004 | Fung et al. |
| 6,814,461 | B2 | 11/2004 | Minalga |
| 6,814,480 | B2 | 11/2004 | Amano |
| 6,822,357 | B2 | 11/2004 | Hung |
| 6,857,756 | B2 | 2/2005 | Reiff et al. |
| 6,863,544 | B2 | 3/2005 | Haehn et al. |
| 6,868,967 | B2 | 3/2005 | Lam |
| RE38,729 | E | 4/2005 | Liu |
| 6,886,961 | B2 | 5/2005 | Hara et al. |
| 6,890,135 | B2 | 5/2005 | Kopras et al. |
| 6,899,451 | B2 | 5/2005 | Kittelmann et al. |
| 6,905,015 | B2 | 6/2005 | Hernandez, Jr. et al. |

(56) References Cited

U.S. PATENT DOCUMENTS 6,905,221 B2 6/2005 Hsu
6,916,106 B2 7/2005 Xingguo
6,918,331 B2 7/2005 Okouchi
6,921,235 B2 7/2005 Chen
6,939,022 B2 9/2005 Brooks
6,960,867 B2 11/2005 Dupont et al.
6,961,190 B1 11/2005 Tamaoki et al.
6,964,545 B1 11/2005 Languasco
6,979,100 B2 12/2005 Reiff et al.
6,979,104 B2 12/2005 Brass et al.
6,991,105 B2 1/2006 Winnard
7,006,306 B2 2/2006 Falicoff et al.
7,007,762 B2 3/2006 Yamamoto
7,025,485 B2 4/2006 Henry
7,029,142 B2 4/2006 Chen et al.
7,053,325 B2 5/2006 Yuasa et al.
7,054,411 B2 5/2006 Katcha et al.
7,069,662 B2 7/2006 Fung et al.
7,080,964 B2 7/2006 Riley et al.
7,090,372 B2 8/2006 Liao et al.
7,093,951 B2 8/2006 Tsuruta et al.
7,094,011 B2 8/2006 Kopras et al.
7,101,058 B2 9/2006 Prell et al.
7,137,761 B2 11/2006 Hara et al.
7,152,329 B2 12/2006 Kondo et al.
7,185,998 B2 3/2007 Oomori et al.
7,188,966 B1 3/2007 Lin
7,195,428 B2 3/2007 Astakhov et al.
7,197,113 B1 3/2007 Katcha et al.
7,200,516 B1 4/2007 Cowley
7,204,606 B2 4/2007 Brass et al.
7,228,983 B2 6/2007 Pangerc et al.
7,249,862 B2 7/2007 Shirane
7,253,541 B2 8/2007 Kovarik et al.
7,258,230 B2 8/2007 Hernandez, Jr. et al.
7,278,751 B2 10/2007 Chang et al.
7,282,818 B2 10/2007 Kovarik
7,296,905 B2 11/2007 Etter et al.
D557,099 S 12/2007 Lin
7,303,007 B2 12/2007 Konschuh et al.
7,307,230 B2 12/2007 Chen
7,318,485 B2 1/2008 Greese et al.
7,331,113 B1 2/2008 Patrick et al.
7,331,685 B2 2/2008 Shen et al.
7,339,323 B2 3/2008 Bucur
7,357,526 B2 4/2008 Zeiler
7,395,876 B1 7/2008 Walker
7,404,696 B2 7/2008 Campbell
7,483,220 B2 1/2009 Kittelmann et al.
7,498,526 B2 3/2009 Lohr et al.
7,510,296 B2 3/2009 Nevin
7,552,781 B2 6/2009 Zhang et al.
7,559,427 B2 7/2009 Hu
7,568,288 B2 8/2009 Baker
7,568,816 B2 8/2009 Brass et al.
7,600,885 B2 * 10/2009 Canino et al. ..... 362/119
7,654,178 B2 2/2010 Hall et al.
7,677,752 B2 3/2010 Tadokoro et al.
7,681,659 B2 3/2010 Zhang et al.
7,682,035 B2 3/2010 Wuensch et al.
7,682,036 B2 3/2010 Reiff et al.
7,703,950 B2 4/2010 Ewert et al.
7,705,482 B2 4/2010 Leininger
7,717,619 B2 5/2010 Katcha et al.
7,726,863 B2 6/2010 Brandstaetter et al.
7,728,464 B2 6/2010 Leininger
7,736,009 B2 6/2010 Quattrini
7,740,369 B2 6/2010 Gabriel et al.
7,815,356 B2 10/2010 Lutz et al.
7,824,136 B2 11/2010 Campbell
7,850,325 B2 12/2010 Wall et al.
7,866,839 B2 1/2011 Chien
7,926,187 B2 4/2011 Uehlein-Proctor et al.
7,934,847 B2 5/2011 Oomori et al.
8,016,048 B2 9/2011 Ueda et al.
8,042,966 B2 10/2011 Lutz et al.
8,075,155 B2 12/2011 Watanabe et al.
8,091,650 B2 1/2012 Van der Linde et al.
8,317,350 B2 11/2012 Friedman et al.
8,328,381 B2 * 12/2012 Dixon et al. ..... 362/119
8,360,593 B2 1/2013 Kim et al.
8,382,308 B2 2/2013 Hecht et al.
8,529,084 B2 9/2013 Roehm
2002/0054491 A1 5/2002 Casas
2002/0131267 A1 9/2002 Van Osenbruggen
2002/0136021 A1 9/2002 Hung
2002/0154499 A1 10/2002 Hsieh
2002/0172035 A1 11/2002 Hara et al.
2002/0179437 A1 12/2002 Ko
2002/0197123 A1 12/2002 Kopras et al.
2003/0194283 A1 10/2003 Kovarik et al.
2003/0202851 A1 10/2003 Kovarik
2004/0084342 A1 5/2004 Chang
2004/0156190 A1 8/2004 Tsuruta et al.
2005/0044728 A1 3/2005 Baker
2005/0047878 A1 3/2005 Riley et al.
2005/0085124 A1 4/2005 Kristen et al.
2005/0111214 A1 5/2005 Zeiler
2005/0135800 A1 6/2005 Nguyen et al.
2005/0152131 A1 7/2005 Shirane
2005/0157260 A1 7/2005 Graham et al.
2005/0157489 A1 7/2005 Oomori et al.
2005/0157849 A1 7/2005 Radley et al.
2005/0185300 A1 8/2005 Kittelmann et al.
2005/0188550 A1 9/2005 Uehlein-Proctor et al.
2005/0199522 A1 9/2005 Hu
2005/0218023 A1 10/2005 Winnard
2005/0221664 A1 10/2005 Winnard
2005/0247585 A1 11/2005 Breckwoldt et al.
2005/0248933 A1 11/2005 Chen et al.
2005/0261870 A1 11/2005 Cramer et al.
2006/0104085 A1 5/2006 Walker et al.
2006/0104732 A1 5/2006 Huang
2006/0113930 A1 6/2006 Andriolo
2006/0157260 A1 7/2006 Greese et al.
2006/0176682 A1 8/2006 Wu et al.
2006/0180327 A1 8/2006 Nagasaka et al.
2006/0234846 A1 10/2006 Tucker
2006/0243105 A1 11/2006 Delfini et al.
2006/0250057 A1 11/2006 Vasudeva
2006/0262519 A1 11/2006 Hirschburger et al.
2006/0289595 A1 12/2006 Shen et al.
2007/0046110 A1 3/2007 Liu
2007/0138971 A1 6/2007 Chen
2007/0159812 A1 7/2007 Oomori et al.
2007/0193039 A1 8/2007 Onose et al.
2008/0025017 A1 1/2008 Tadokoro et al.
2008/0041746 A1 2/2008 Hsiao
2008/0060847 A1 3/2008 Konschuh et al.
2008/0068827 A1 3/2008 Chang
2008/0074865 A1 3/2008 Lutz et al.
2008/0144309 A1 6/2008 Nagata et al.
2008/0149678 A1 6/2008 Huang
2008/0150439 A1 6/2008 Bucur
2008/0158861 A1 7/2008 Chiang
2008/0215056 A1 9/2008 Miller et al.
2008/0244910 A1 10/2008 Patel
2008/0264212 A1 10/2008 Leupert
2008/0266841 A1 10/2008 Gabriel et al.
2008/0271906 A1 11/2008 Walker
2008/0278931 A1 11/2008 Wu et al.
2008/0314795 A1 12/2008 Lin
2009/0013477 A1 1/2009 Agronin et al.
2009/0077814 A1 3/2009 Gibbons et al.
2009/0077816 A1 3/2009 Gibbons et al.
2009/0077817 A1 3/2009 Gibbons et al.
2009/0077819 A1 3/2009 Kuehne et al.
2009/0080987 A1 3/2009 Canino et al.
2009/0123817 A1 5/2009 Stickel et al.
2009/0128062 A1 5/2009 Watanabe et al.
2009/0134710 A1 5/2009 Tyndall et al.
2009/0141482 A1 6/2009 Wall et al.
2009/0145259 A1 6/2009 Wall et al.
2009/0159677 A1 6/2009 Yakimov et al.

(56) References Cited

U.S. PATENT DOCUMENTS

| | | | |
|---|---|---|---|
| 2009/0200961 | A1 | 8/2009 | Straub |
| 2009/0207035 | A1 | 8/2009 | Watanabe et al. |
| 2009/0256319 | A1 | 10/2009 | Seymour et al. |
| 2009/0309519 | A1 | 12/2009 | Suzuki et al. |
| 2009/0313831 | A1 | 12/2009 | Patel |
| 2010/0000094 | A1 | 1/2010 | Lombardo |
| 2010/0002415 | A1 | 1/2010 | Munn et al. |
| 2010/0008079 | A1 | 1/2010 | Brass et al. |
| 2010/0038103 | A1 | 2/2010 | Ueda et al. |
| 2010/0043603 | A1 | 2/2010 | McRoberts et al. |
| 2010/0053940 | A1 | 3/2010 | Yaksich |
| 2010/0071921 | A1 | 3/2010 | Canino et al. |
| 2010/0072833 | A1 | 3/2010 | Canino et al. |
| 2010/0074700 | A1 | 3/2010 | Canino et al. |
| 2010/0089601 | A1 | 4/2010 | Fukinuki et al. |
| 2010/0148505 | A1 | 6/2010 | Dunlap et al. |
| 2010/0149790 | A1 | 6/2010 | Leong |
| 2010/0214768 | A1 | 8/2010 | Dixon et al. |
| 2010/0242695 | A1 | 9/2010 | Xu et al. |
| 2010/0277897 | A1 | 11/2010 | Hecht et al. |
| 2010/0315804 | A1 | 12/2010 | Nishikimi et al. |
| 2010/0328929 | A1 | 12/2010 | Lutz et al. |
| 2010/0328969 | A1 | 12/2010 | Meyer |
| 2011/0017473 | A1 | 1/2011 | Clarkson et al. |
| 2011/0040235 | A1 | 2/2011 | Castel |
| 2011/0058356 | A1 | 3/2011 | Friedman et al. |
| 2011/0170312 | A1 | 7/2011 | Parrinello |
| 2011/0197458 | A1 | 8/2011 | Karrar et al. |
| 2012/0236545 | A1 | 9/2012 | Van der Linde et al. |
| 2012/0243225 | A1 | 9/2012 | Lee et al. |
| 2013/0021783 | A1 | 1/2013 | Vanko et al. |

FOREIGN PATENT DOCUMENTS

| | | | |
|---|---|---|---|
| DE | 6806826 | U | 3/1969 |
| DE | 1808818 | A1 | 6/1970 |
| DE | 2529668 | A1 | 1/1977 |
| DE | 7704943 | U1 | 6/1977 |
| DE | 2819691 | A1 | 11/1979 |
| DE | 3003703 | A1 | 8/1980 |
| DE | 8529779 | U1 | 12/1985 |
| DE | 3525352 | A1 | 1/1987 |
| DE | 3831344 | A1 | 3/1990 |
| DE | 8912224 | U1 | 12/1990 |
| DE | 4202223 | A1 | 9/1992 |
| DE | 4229282 | A1 | 5/1993 |
| DE | 4336730 | A1 | 5/1995 |
| DE | 4420999 | A1 | 12/1995 |
| DE | 29709437 | U1 | 9/1997 |
| DE | 29719020 | U1 | 12/1997 |
| DE | 29807070 | U1 | 6/1998 |
| DE | 29818802 | U1 | 1/1999 |
| DE | 29907922 | U1 | 8/1999 |
| DE | 10119010 | A1 | 10/2002 |
| DE | 20215382 | U1 | 3/2003 |
| DE | 20201300 | U1 | 7/2003 |
| DE | 20310541 | U1 | 9/2003 |
| DE | 10315980 | A1 | 11/2003 |
| DE | 10246772 | A1 | 4/2004 |
| DE | 202004019853 | U1 | 2/2005 |
| DE | 10340178 | B3 | 4/2005 |
| DE | 10356384 | A1 | 6/2005 |
| DE | 102004011575 | A1 | 9/2005 |
| DE | 202007010340 | U1 | 10/2007 |
| DE | 102006045157 | A1 | 4/2008 |
| DE | 102006049925 | A1 | 4/2008 |
| DE | 202008003787 | U1 | 6/2008 |
| DE | 202008016901 | U1 | 3/2009 |
| DE | 102011075663 | A1 | 11/2012 |
| DE | 1020 1077444 | A1 | 12/2012 |
| DE | 102011077440 | A1 | 12/2012 |
| DE | 102011077441 | A1 | 12/2012 |
| DE | 102011077442 | A1 | 12/2012 |
| DE | 102011077443 | A1 | 12/2012 |
| DE | 102011077451 | A1 | 12/2012 |
| EP | 0280527 | A2 | 8/1988 |
| EP | 1068934 | A1 | 1/2001 |
| EP | 1072842 | A2 | 1/2001 |
| EP | 1125698 | A2 | 8/2001 |
| EP | 1287948 | A2 | 3/2003 |
| EP | 1477282 | A1 | 11/2004 |
| EP | 1690649 | A1 | 8/2006 |
| EP | 1693162 | A2 | 8/2006 |
| EP | 2199024 | A1 | 6/2010 |
| EP | 2223783 | A1 | 9/2010 |
| FR | 667849 | A | 10/1929 |
| GB | 2041189 | A | 9/1980 |
| GB | 2041798 | A | 9/1980 |
| GB | 2305128 | A | 4/1997 |
| GB | 2375497 | A | 11/2002 |
| GB | 2407058 | A | 4/2005 |
| JP | S6460447 | A | 3/1989 |
| JP | 3138168 | A | 6/1991 |
| JP | 5309508 | A | 11/1993 |
| JP | 06246645 | A | 9/1994 |
| JP | 8252778 | A | 10/1996 |
| JP | 9239672 | A | 9/1997 |
| JP | 10034564 | A | 2/1998 |
| JP | 10034565 | A | 2/1998 |
| JP | 10034566 | A | 2/1998 |
| JP | 11111002 | A | 4/1999 |
| JP | 3079279 | B2 | 8/2000 |
| JP | 2002166374 | A | 6/2002 |
| JP | 2002307325 | A | 10/2002 |
| JP | 2002307330 | A | 10/2002 |
| JP | 2003033901 | A | 2/2003 |
| JP | 2003211374 | A | 7/2003 |
| JP | 2004174667 | A | 6/2004 |
| JP | 2006218583 | A | 8/2006 |
| JP | 2009214239 | A | 9/2009 |
| JP | 2010207972 | A | 9/2010 |
| WO | WO-9902310 | A2 | 1/1999 |
| WO | WO-03061915 | A1 | 7/2003 |
| WO | WO-2005018855 | A1 | 3/2005 |
| WO | WO-2006015909 | A1 | 2/2006 |
| WO | WO-2008133339 | A1 | 11/2008 |
| WO | WO-2009080404 | A1 | 7/2009 |
| WO | WO-2009138269 | A1 | 11/2009 |
| WO | WO-2010034566 | A1 | 4/2010 |

OTHER PUBLICATIONS

"Eluminate Series," Makita, internet: http://www.makita.com/tools_item_view.asp?Id=638.
Print-off from unknown website.
Photographs of disassembled tools currently being sold.
Hitachi brochure. Date unknown.
Photographs of a partly disassembled currently sold Bosch tool.
Printouts of tools from websites. Website and date unknown.
Photocopies of brochures. Dated.
David, Radu—European Search Report for EP 12177787—Oct. 22, 2013—4 pages—The Hague.
David, Radu—European Search Report for EP 13176802—Oct. 22, 2013—6 pages—The Hague.

* cited by examiner

LIGHT FOR A POWER TOOL AND METHOD OF ILLUMINATING A WORKPIECE

RELATED APPLICATIONS

This application is a continuation of, and claims priority to, U.S. patent application Ser. No. 12/379,585, filed Feb. 25, 2009, titled "Light for a Power Tool and Method of Illuminating a Workpiece," which is incorporated by reference.

FIELD OF THE INVENTION

The present application relates generally to handheld power tools. More particularly, the present application relates to handheld power tools having a light configured to shine onto a workpiece machined by the power tool.

BACKGROUND OF THE INVENTION

Power tools are often used in a variety of conditions ranging from well-lit indoor work spaces to outside construction sites or other areas that are not always well-lit. Accordingly, it is desirable to provide a method or apparatus that permits a power tool to have a lighting feature that will illuminate the workpiece that is being machined or worked on by the power tool. Such a lighting feature will assist a user to be able to adequately see the workpiece or work area that is being worked on or machined by the power tool even in substandard light conditions.

Because power tools may be used in adverse environmental conditions, it is desirable to protect such a lighting feature from the adverse environmental conditions.

SUMMARY OF THE INVENTION

The foregoing needs are met, to a great extent, by the present invention, wherein in one aspect an apparatus is provided that in some embodiments provides a power tool having lighting features that will illuminate a workpiece being machined by the power tool. In some embodiments in accordance with the invention, the lighting feature is protected from the environment in which the power tool operates.

In accordance with one embodiment of the present invention, a power tool is provided. The power tool includes a housing, a end effector rotatable with respect to the housing, a collar rotatable with respect to the housing, a printed circuit board (PCB) rotatably fixed with respect to the housing, and a lighting element operatively connected to the PCB and adjacent to the end effector and in a recess of the collar and located to illuminate a workpiece machined by the power tool.

In accordance with another embodiment of the present invention, a power tool is provided. The power tool includes a rotatable end effector, a rotatable collar, a printed circuit board (PCB), lighting elements operatively connected to the PCB and adjacent to the end effector and located to illuminate a workpiece machined by the power tool, and a guide supporting the PCB and wires configured to provide power to the PCB for illuminating the lighting elements, wherein the PCB and a portion of the guide are generally circular in shape, the lighting elements are annularly arranged on the PCB and portion of the end effector extends through a hole in the defined by the guide and PCB and the guide defines a groove and the PCB is located in the groove.

In accordance with yet another embodiment of the present invention, a method of providing light for a workpiece being machined by a power tool is provided. The method includes locating lighting elements around a spindle of a power tool, aligning the lighting elements to shine light on a workpiece being machined by the power tool, operatively connecting the lighting elements to a PCB, containing and supporting the PCB with a guide, supporting wires configured to provide power to the PCB with the guide, locating the lighting elements, PCB and guide in a rotatable collar, and preventing the lighting elements, PCB and guide from rotating when the collar rotates.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
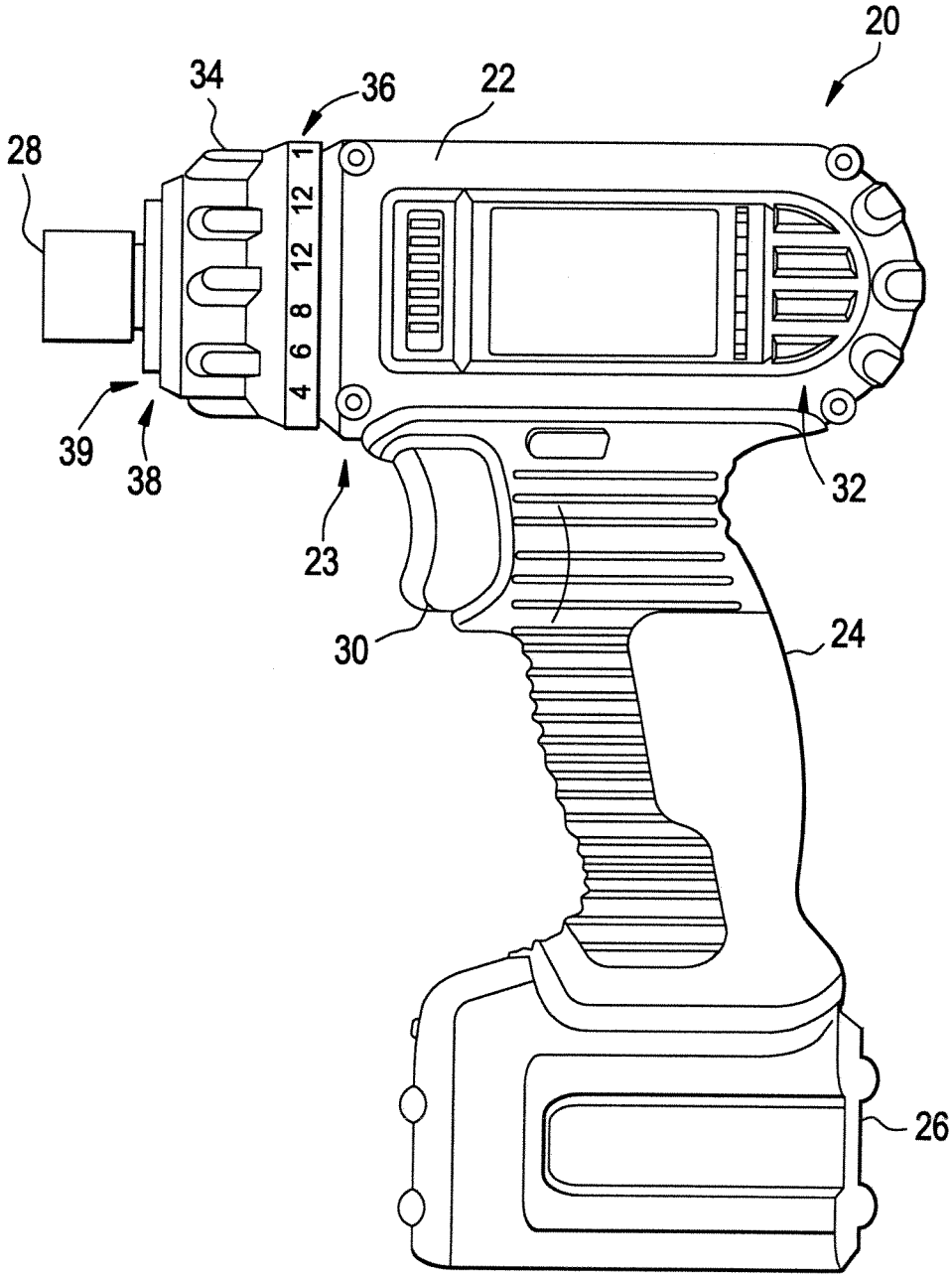
FIG. 1 is a side view illustrating a power tool in accordance with an embodiment of the invention.

The invention will now be described with reference to the drawing figures, in which like reference numerals refer to like parts throughout. An embodiment in accordance with the present invention provides a power tool having a light ring configured to shine light onto a workpiece being machined by the power tool.

According to some embodiments of the invention, light emitting elements, such as light emitting diodes (LEDs), are placed in an annular or ring shape around part of the end effector and are configured to shine forward to illuminate the tool or accessory held by the end effector and the workpiece being machined by the tool. The end effector may be a tool or accessory holder mounted to an output spindle of the tool. Examples of end effectors that may be used in accordance with the invention may be the 7000 Series chuck manufactured and marketed by the Jacobs Chuck Manufacturing Company of Clemson, S.C. and quick change chucks similar to that which is found on products such as a DC825KA Impact Driver and a DC815KA Impact Driver that are manufactured and marketed by the DeWalt Industrial Tool Company of Baltimore, Md.

While several different types of lighting elements can be used in accordance with the invention, such as light bulbs (for example, xenon bulbs) or other lighting elements, LED lights are discussed here as an example and do not limit embodiments in accordance with the invention to tools using LEDs. The LED lights, or other lighting elements, and associated parts are locked to the housing of the tool and do not rotate when the power tool is operated. The lights may be powered by the same power source that provides power to the power tool's motor. In the case of most cordless power tools, it is a battery that powers the power tool and in the case of corded tools it is AC current provided from source voltage through a cord. This AC current may be modified according to the needs of the lighting device being employed. In the case of LED lights, a rectifer may be employed to convert AC current to DC.

An embodiment in accordance with the invention is illustrated in FIG. 1. FIG. 1 shows a power driver 20. The power driver 20 has a housing 22. The housing may be of a clam shell type or any other suitable type housing. The power driver 20 may have a nose cone 23 located at the front portion of the power driver 20. A handle 24 projects downwardly from the housing 22 and is terminated with a battery 26. The battery 26 provides the power to turn the end effector 28.

The end effector 28 may be configured to hold an accessory or tool such as a drill bit or a driving type accessory such as a Philips or standard screwdriver. Other types of tools or accessories may be held and used in the end effector 28 as can appreciated by one skilled in the art. The movement of the end effector 28 may be controlled by the trigger 30. The trigger 30 may selectively provide power from the battery 26 to the motor 32 located within the housing 22. In some embodiments of the invention, the more the trigger or switch 30 is depressed the more power may be applied to the motor 32 which may cause the end effector 28 to spin faster.

The power driver 20 may be equipped with a clutch collar 34. Other embodiments in accordance with the invention may not have a rotating clutch collar, but rather a different rotating collar mechanism. The rotating collar mechanism may be a drill/hammer mode selector, a gear shifter, an on/off switch, a tool variable speed control or other rotating collar control mechanism. However, this specification will refer to a clutch collar as an example but does not limit embodiments in accordance with the invention to tools having clutch collars. The clutch collar 34 can provide protection for interior portions of the power driver 20, particularly the transmission and other internal components of the power driver 20 that may be mounted on the nose cone 23. The clutch collar 34 may be rotated to adjust the transmission. An example of a clutch and transmission that may work in accordance with the invention is shown in U.S. Pat. No. 7,066,691 which is incorporated by reference in its entirety. Of course, most any type of clutch and transmission may be used in accordance with the invention. Different angular positions of the clutch collar 34 may provide different amounts of torque and/or speed to the end effector 28 for a given trigger 30 position. A numbered scale 36 may appear on the clutch collar 34 in order to provide a user an indication of the setting of the clutch collar 34. In some embodiments the user may turn the clutch collar 34 to a desired position by hand.

A light ring 38 is located on a front portion of the power tool 20 just behind the end effector 28 in a recess 39 in the clutch collar 34.

Figure 2:
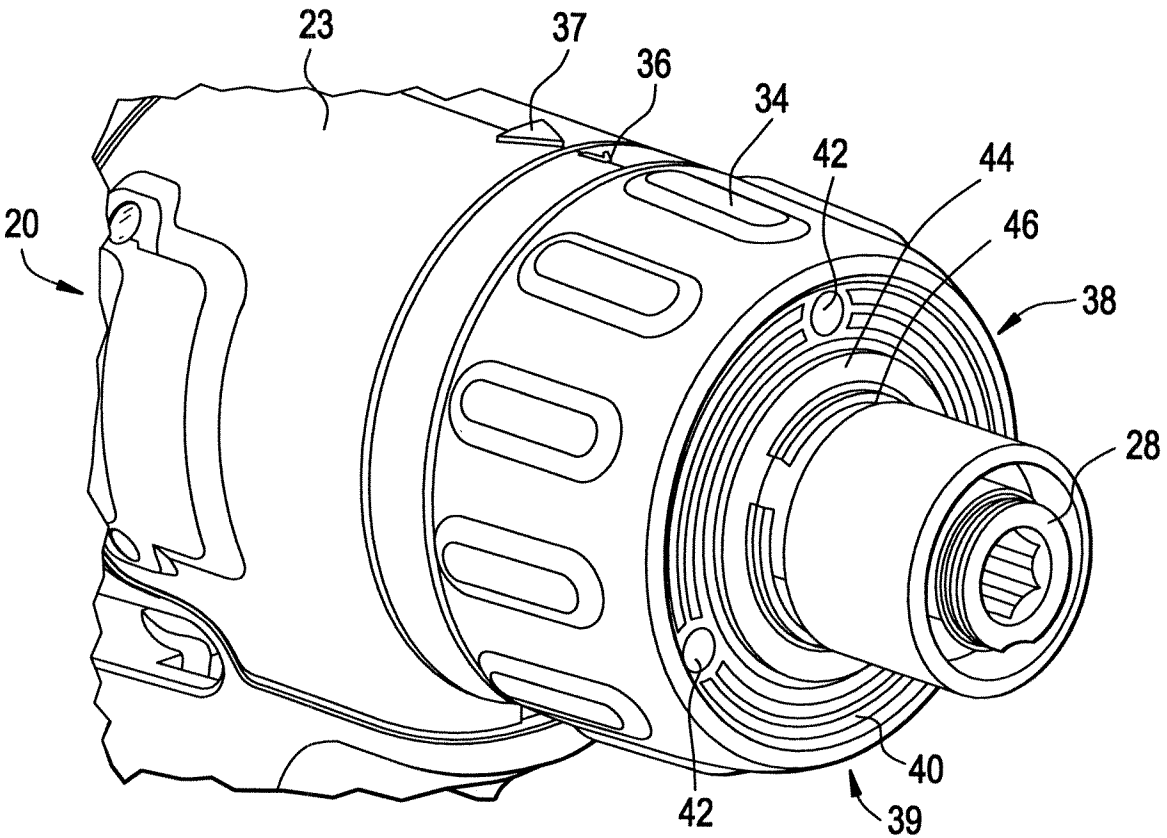
FIG. 2 is a perspective view illustrating a front portion of a power tool in accordance with an embodiment of the invention.
Figure 5:
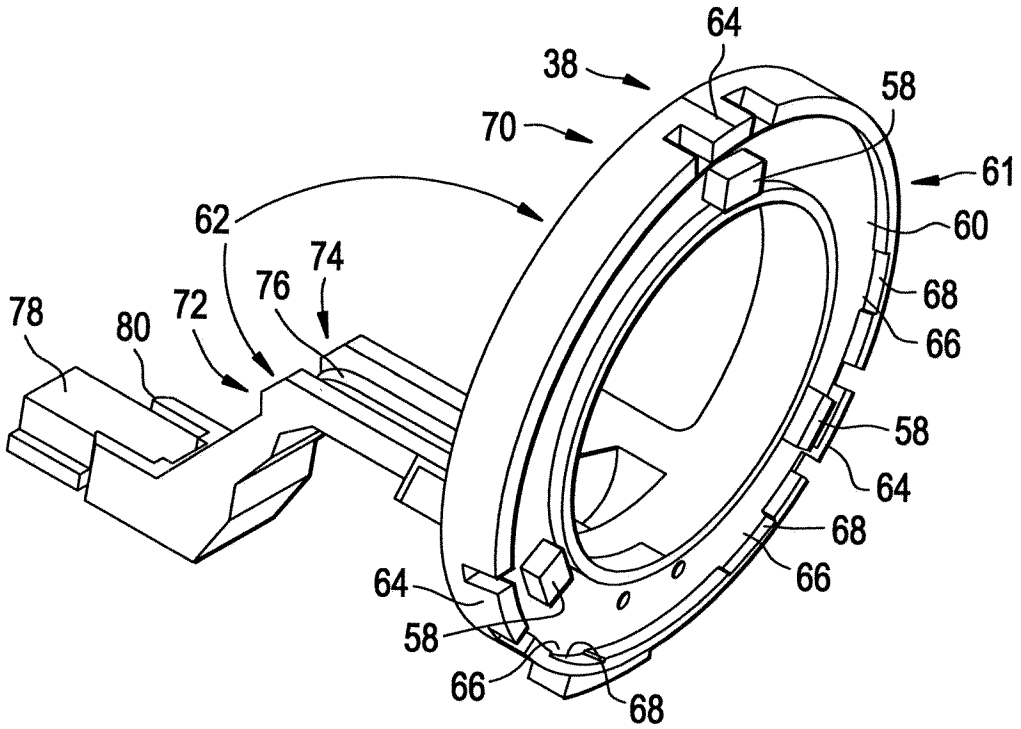
FIG. 5 is a perspective view of a wire guide and printed circuit board (PCB) having light emitting diode (LED) elements.

In FIG. 2, a partial perspective view of a front portion of the power driver 20 is shown. An indicator 37 may be located on the nose cone 23. The indicator 37 may provide a reference for the user for determining the angular position of the clutch collar 34 and a reference point for comparing the numbers on the numbered scale 36. The light ring 38 is located within a recess 39 of the clutch collar 34. The light ring 38 may include a lens cover 40. The lens cover 40 may protect interior components of the tool from moisture or other contaminants. The lens cover 40 may include blisters 42 located on the lens cover 40 as to be directly over the LEDs 58 (as shown in FIG. 5). The blisters 42 may be translucent or clear in order to permit light generated by the LEDs 58 to pass through. In some embodiments the blisters 42 may direct or focus the light. The blisters 42 may be round, rectangular, square or any other shape. In some embodiments the blisters 42 are shaped to correspond with the shape of the lighting elements 58. In other embodiments the light may simply pass through the blisters 42. The remainder of the lens cover 40 may be a dark color. Other color schemes may be used in accordance with the invention.

The lens cover 40 is held axially in place from moving in a forward direction toward the end effector 28 by retaining ring 44. The retaining ring 44 is mounted on a retainer 46 which is part of the nose cone 37 as better illustrated in FIGS. 13 and 14 and described in more detail later below.

Figure 3:
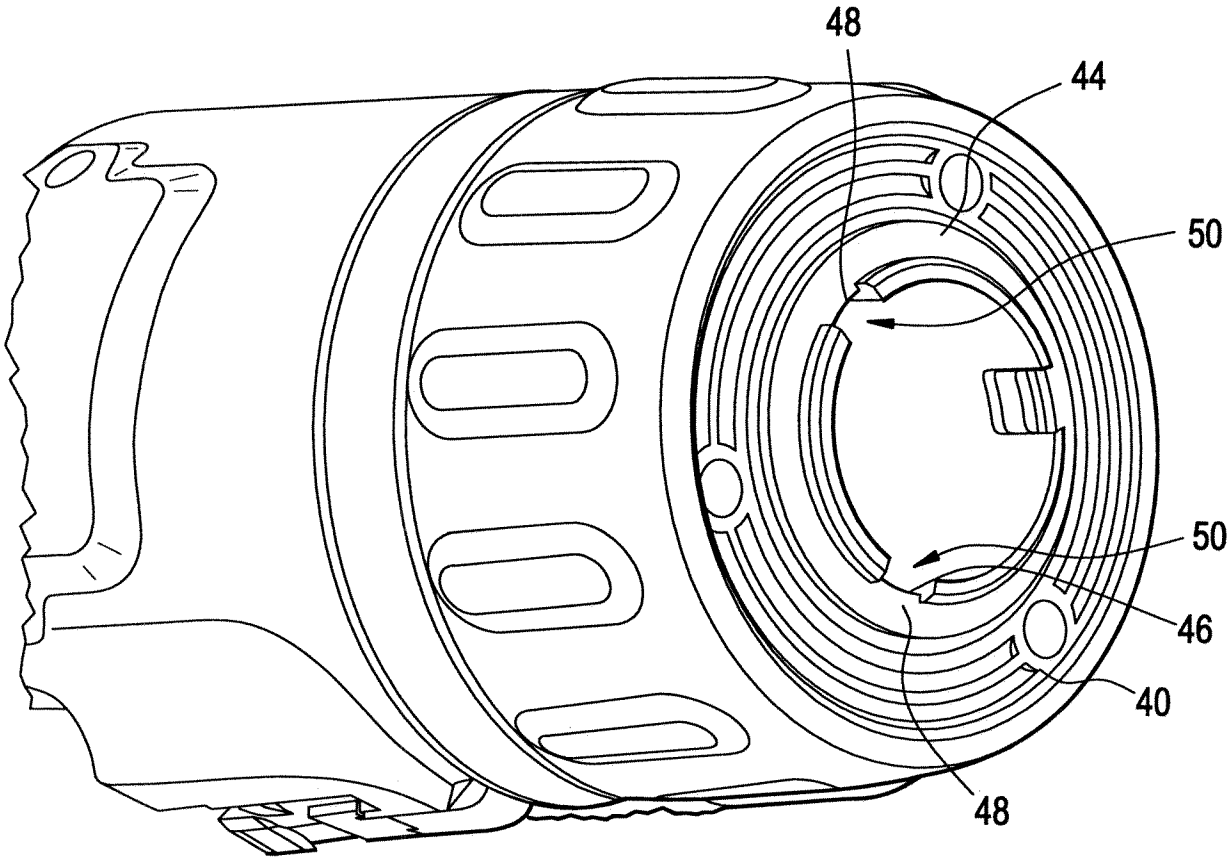
FIG. 3 is a perspective close-up view of the power tool of FIG. 2 with the end effector removed in order to more distinctly show surrounding elements.

FIG. 3 is a similar view to that shown in FIG. 2, however, the end effector 28 is removed to better illustrate certain features associated with the retaining ring 44 and the retainer 46. FIG. 3 shows portions 48 of the retaining ring 44 exposed in gap 50 that would fit within the groove 52 if it were not in the gap 50. The retaining ring 44 fits within a groove 52 in the retainer 46. When the retaining ring 44 is placed in the groove 52 the retaining ring 44 is secured in place. The retaining ring 44 prevents the lens cover 40 from axially moving forward toward the end effector 28.

Figure 4:
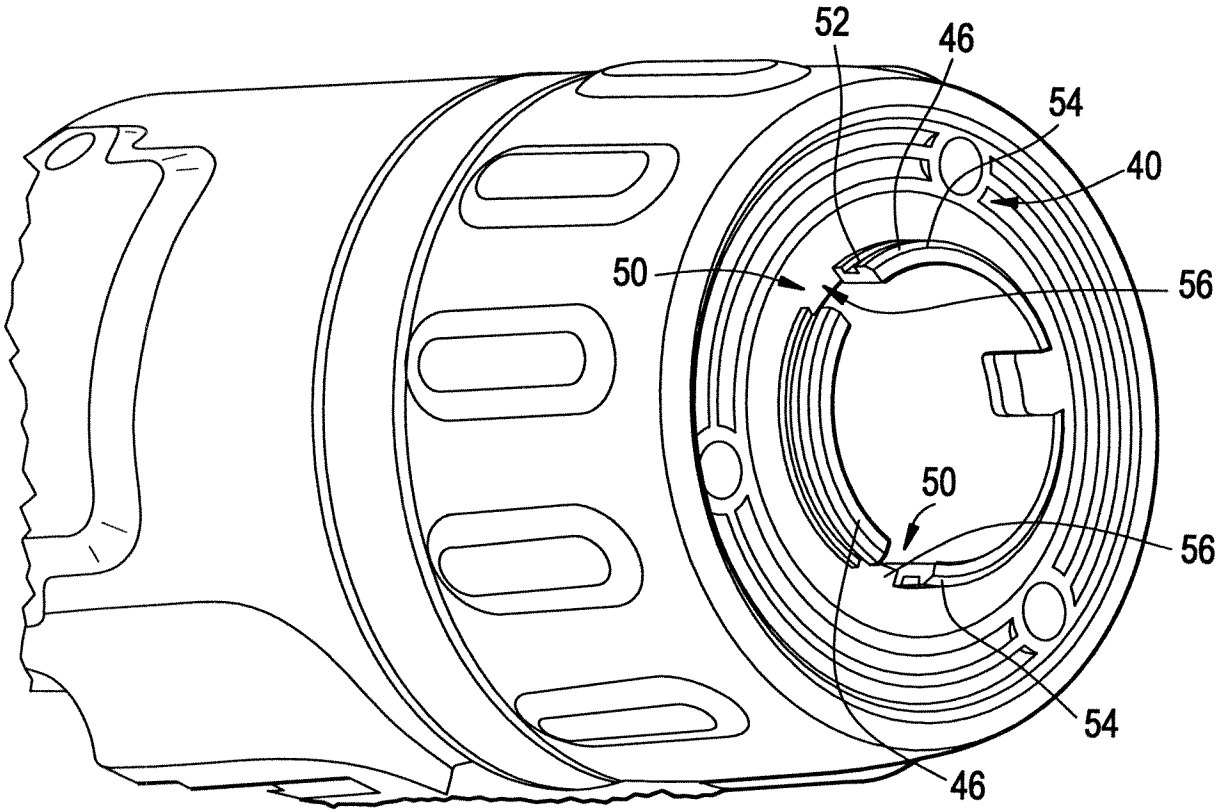
FIG. 4 is a perspective view similar to that shown in FIG. 3 with a retaining ring removed in order to more clearly show surrounding elements.

FIG. 4 is a similar view as that shown in FIG. 3, however, the retaining ring 44 has been removed as well as the end effector 28 to better illustrate features of the lens cover 40 and the retainer 46. The lens cover 40 includes tabs 56 which are located within the gaps 50 of the retainer 46. The tab 56 and gap 50 combination keep the lens cover 40 aligned and from rotating around the retainer 46. The groove 52 is also illustrated in FIG. 4 in which the retaining ring 44 is located as shown in FIG. 3.

FIG. 5 illustrates other aspects of the light ring 38 which are normally contained within the clutch collar 34 and located behind the lens cover 40. As part of the light ring 38, light emitting diodes or LEDs 58 are located at various points around the light ring 38. In some embodiments in accordance with the invention, the LEDs 58 emit white light although in other embodiments the LEDs 58 might emit other colors of light. In some embodiments different LEDs on the same tool could emit different colors of light. While the embodiment shown in FIG. 5 illustrates three LEDs 58 any number of LEDs may be used in accordance with the invention including one or more.

The LEDs 58 are mounted to a ring-shaped printed circuit board or PCB 60. The PCB 60 and LEDs 58 are fit into a trench 61 in the wire way 62. The wire way 62 and trench 61 may allow for potting of the PCB if necessary. The wire way 62 provides protection and structural strength for the PCB so that undue mechanical loads are not placed upon the PCB 60. Such support is desirable as a PCB 60 may be fragile and subject to breaking or malfunctioning. The wire way 62 may include snap-in features 64 which allow the PCB 60 to be pushed into the wire way 62 and then the snap-in features 64 snap out once the PCB 60 is located within the wire way 62. The snap-in features 64 prevent the PCB 60 from coming out of the wire way 62.

The wire way 62 may include grooves 66. Tabs 68 located on the PCB 62 may fit within the grooves 66 within the wire way 62. The tabs 68 and grooves 66 combination help the PCB 60 and the wire way 62 be aligned and may prevent or resist the PCB 60 from rotating with respect to the wire way 62.

The wire way 62 may include a PCB holding portion 70 which is generally circular in shape and a wire supporting portion 72. The wire supporting portion 72 may include a channel 74 which is sized and located to contain wires 76. The wires 76 may provide power to the PCB 60 which in turns provides power to illuminate the LEDs 58. The wire supporting portion 72 of the wire way 62 provides a structure for the wires 76 to be supported in and provides protection for the wires 76. The wires 76 may terminate with a plug 78. The plug 78 may fit into plug supporting structure 80 located within the wire supporting portion 72 so that the plug 78, which is made of a more rigid material than the wires 76, is held securely to the wire way 62 via the plug supporting structure 80. In some embodiments, the plug 78 may be press fit into the wire supporting portion 72 of the wire way 62. The circuit to which the PCB 60 is connected may also include an electromagnetic surge suppression circuit (such as a zener diode) for static and over-voltage protection. The circuit may also include a resistor or resistors to drop the voltage from the battery pack voltage to an appropriate level for the LEDs.

Some embodiments do not have a separate PCB, wire guide, wires and connector. For example, plated plastics can be used whereby the wire guide could be first molded into a shape similar to the wire guide 62 as shown. Secondly, tracks (like on a standard PCB) could be created on this plastic piece, and could include all of the pads to mount LEDs and other components, the tracks, or "wires," from the front of the tool back to the connector area, and could even include the male end of the connector. The components (diodes, resistors, etc.) could then be soldered to this one piece, and would be electrically connected back to the place where the wires would connect it to the switch. This would greatly simplify the assembly.

Figure 6:
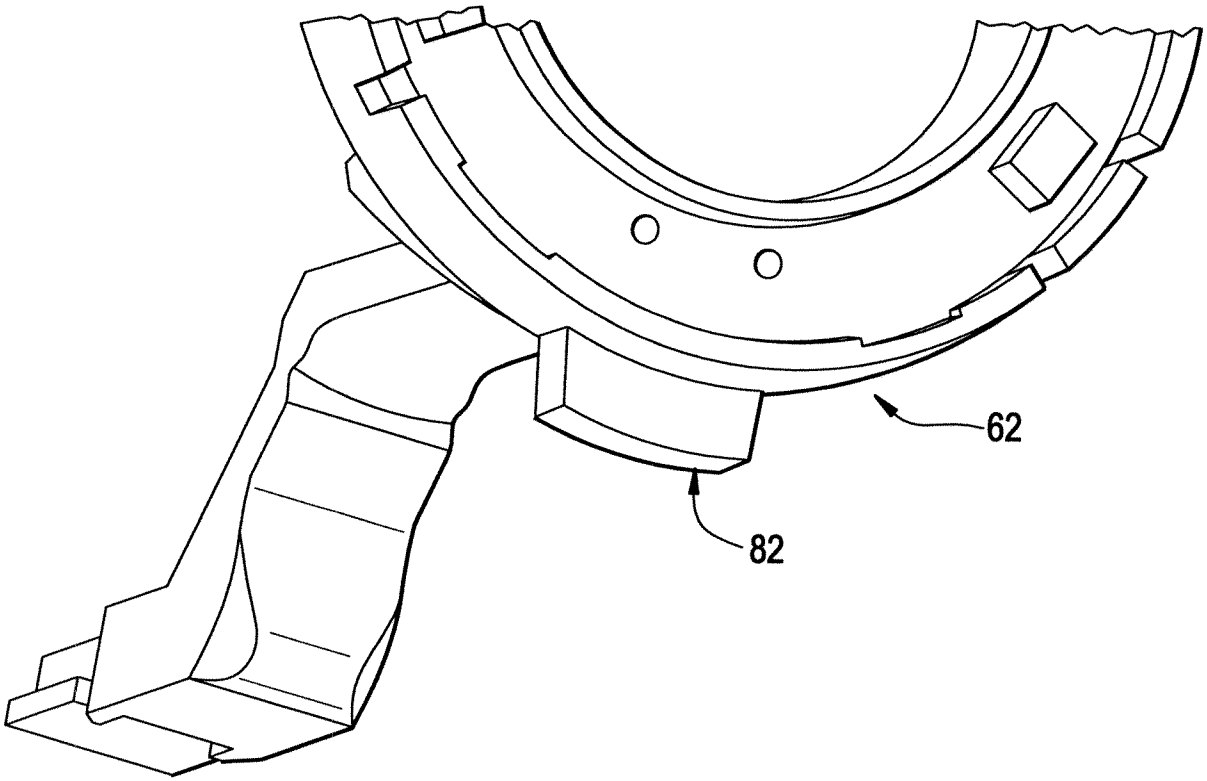
FIG. 6 is a partial perspective view of a bottom portion of the wire guide and PCB.
Figure 12:
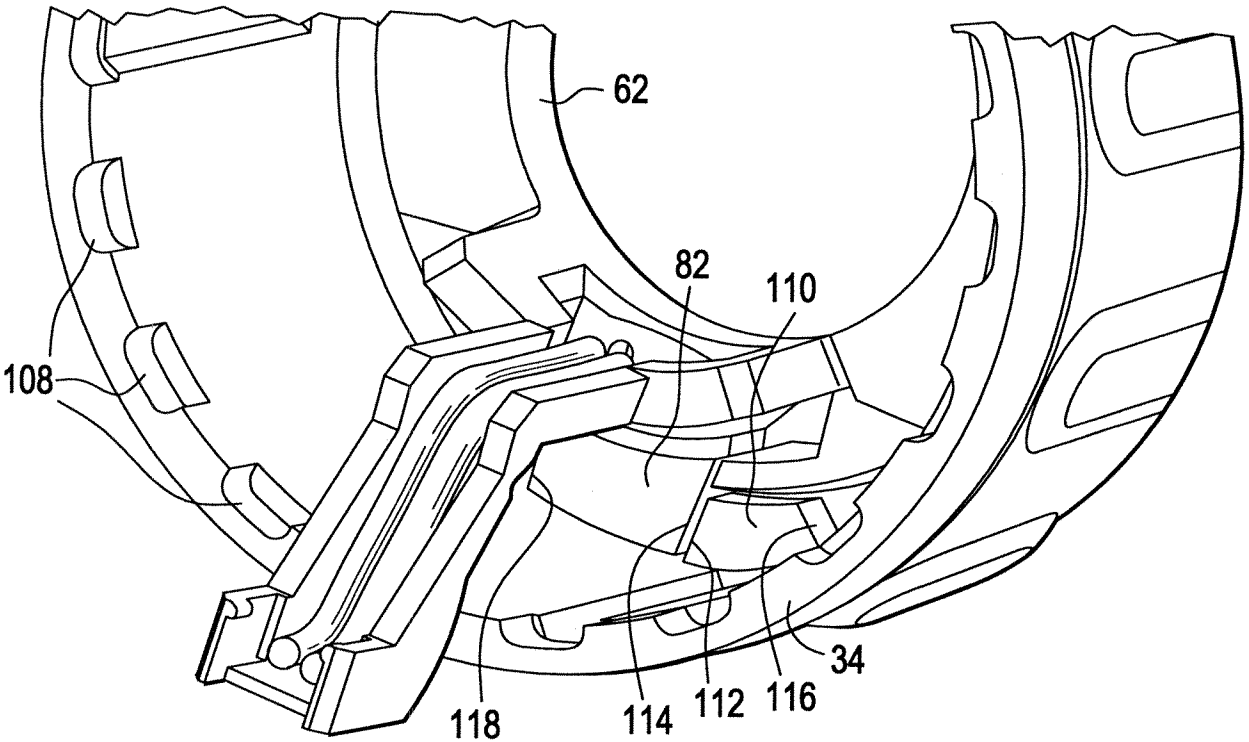
FIG. 12 is a partial rear perspective view of the wire guide mounted on the clutch collar.

FIG. 6 is a partial perspective view of a bottom portion of the wire way 62. The wire way 62 may be equipped with a collar stopping tab 82 which will be explained in more detail below as FIG. 12 is discussed.

Figure 7:
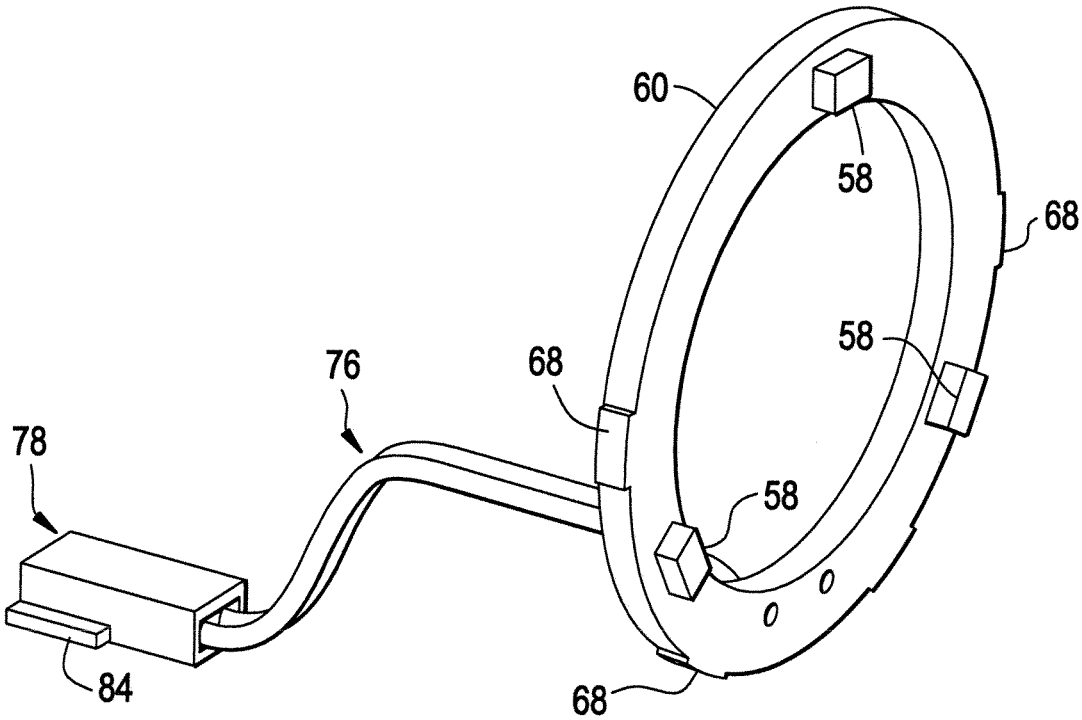
FIG. 7 is a perspective view of the PCB and wires with the wire guide removed.

FIG. 7 is a perspective view similar to that shown in FIG. 5, however, the wire way 62 has been removed in order to better illustrate some of the features shown in FIG. 7. The LEDs 58 are mounted onto the PCB 60. The PCB 60 shows the tabs 68. While the embodiments shown in the figures show five tabs 68, one skilled in the art can appreciate that other numbers of tabs or other features may be employed in order to help keep the PCB aligned and/or rotationally locked to the wire way 68.

The wires 76 are attached to a rear portion of the PCB 60. The plug 78 includes the plug stopping structure 84 which butts against a portion of the wire way 68 to prevent the plug 78 from being inserted too far into the wire way 62.

Figure 8:
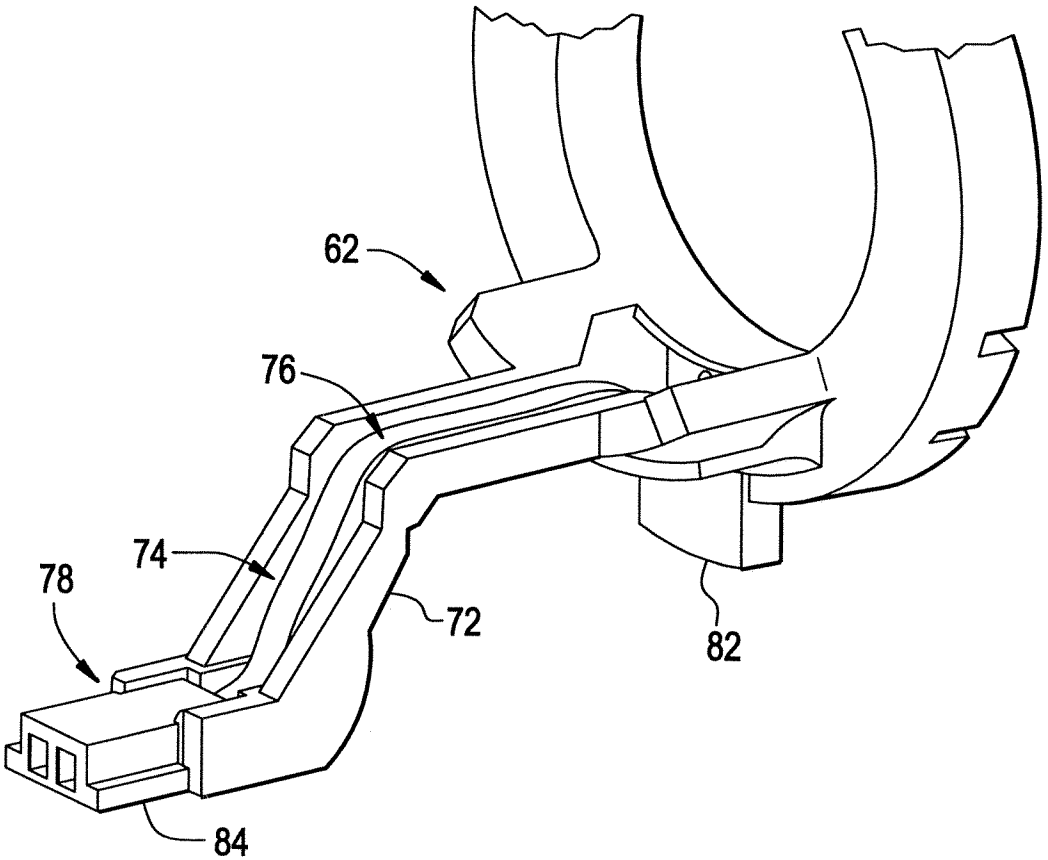
FIG. 8 is a partial perspective rear view of the wire guide, PCB, and wires.

FIG. 8 illustrates the plug stopping structure 84 located on the plug 78 butted against the wire supporting portion 72 of the wire way 62. The wires 76 are located within the channel 74. In some embodiments, the plug 78 snaps into the wire supporting portion 72 and the wires 76 may be pressed into the channel 74 in a press fit manner to secure the wires 76 into the channel 74. A rear portion of the collar stopping tab 82 is also illustrated in FIG. 8.

Figure 9:
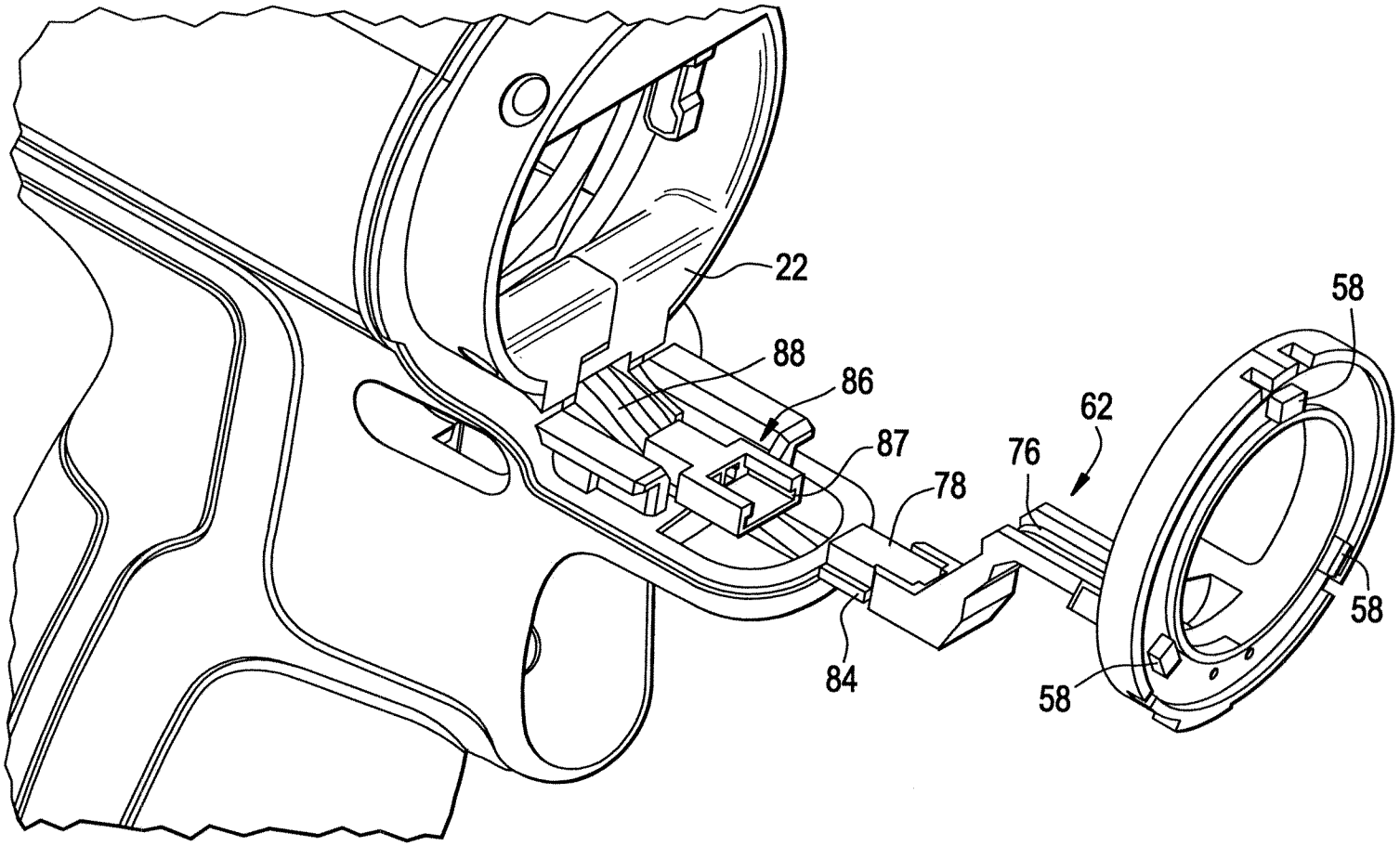
FIG. 9 is a partial exploded perspective view of the wire guide and a power tool having some elements removed to better show other elements.

FIG. 9 illustrates the housing 22 and the wire way 62. The nose cone 23 has been removed in order to better illustrate how the plug 78 attaches to a receiving plug 86. The plug 78 is slid into the receiving plug 76. The plug stopping structure 84 slides into slots 87 located on the receiving plug 86. Once the plug 78 and the receiving plug 86 have been mated together, power from the wires 88 is communicated to the wire 76. The joint made of the plug 78 and the receiving plug 86 provide a rigid support for the connection of the wires 76 and 88. The wires 88 may receive power from the battery 26 as controlled by the trigger 30. In some embodiments the wires 88 extend out of a switch body associated with the trigger 30. In other embodiments, a switch body could have connectors to which the wires 88 are soldered or otherwise connected. The trigger switch may include electronics for variable speed control. The wires 88 may be soldered to a PCB located inside the switch body.

In accordance with some embodiments of the invention, when the trigger 30, as shown in FIG. 1, is depressed, power is sent to the wires 88 and in turn 76 to illuminate the LEDs.

Figure 10:
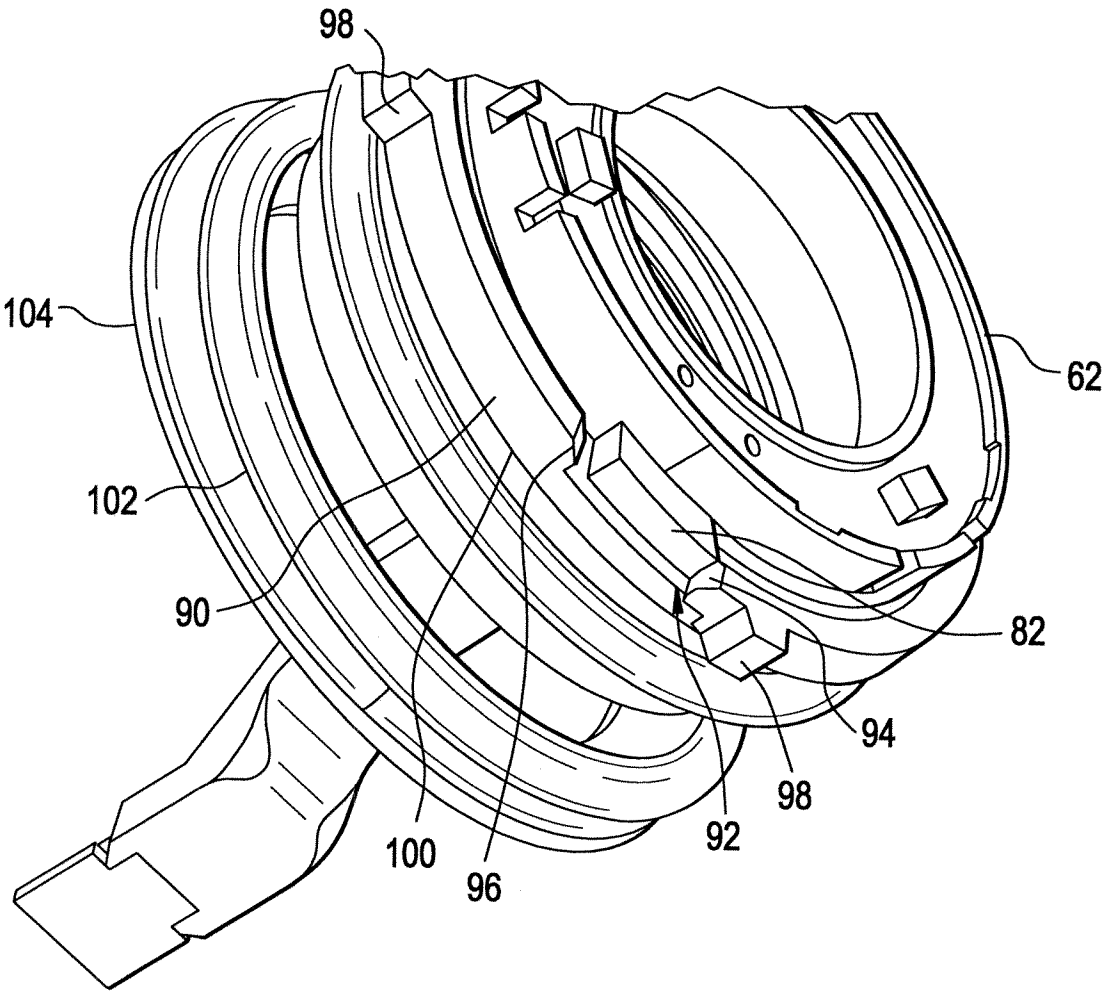
FIG. 10 is a partial perspective view of a wire guide, clutch adjusting nut, clutch spring, and clutch washer mounted on the wire guide.

FIG. 10 is a partial perspective view of the guide 62 showing several additional elements on the guide 62. A clutch adjusting nut 90 is butted against the guide 62. The stop tab 82 is fit into a notch 92 in the clutch adjusting nut 90. The notch 92 in the clutch adjusting nut 90 aligns to the stopping tab 82 on the guide 62 to assist in providing proper assembly of the threads between the adjusting nut 90 and the nose cone 23 during assembly. In some embodiments and as shown in FIG. 10, the notch 92 and the clutch adjusting nut 90 may have chamfered edges 96 to the notch walls 94. The chamfered edges 96 may assist in the stopping tab 82 to be seated in the notch 92 and the clutch adjusting nut 90.

According to some embodiments, a combination of the notch 92 and the clutch adjusting nut 70 and the stopping tab 82 in combination with the other tabs and notch combinations 50, 56, 66, 68 can assure that the lens cover 40, the nose cone 23, the wire way 62, the PCB 60, and the clutch adjusting nut 90 are aligned with respect to each other.

Figure 11:
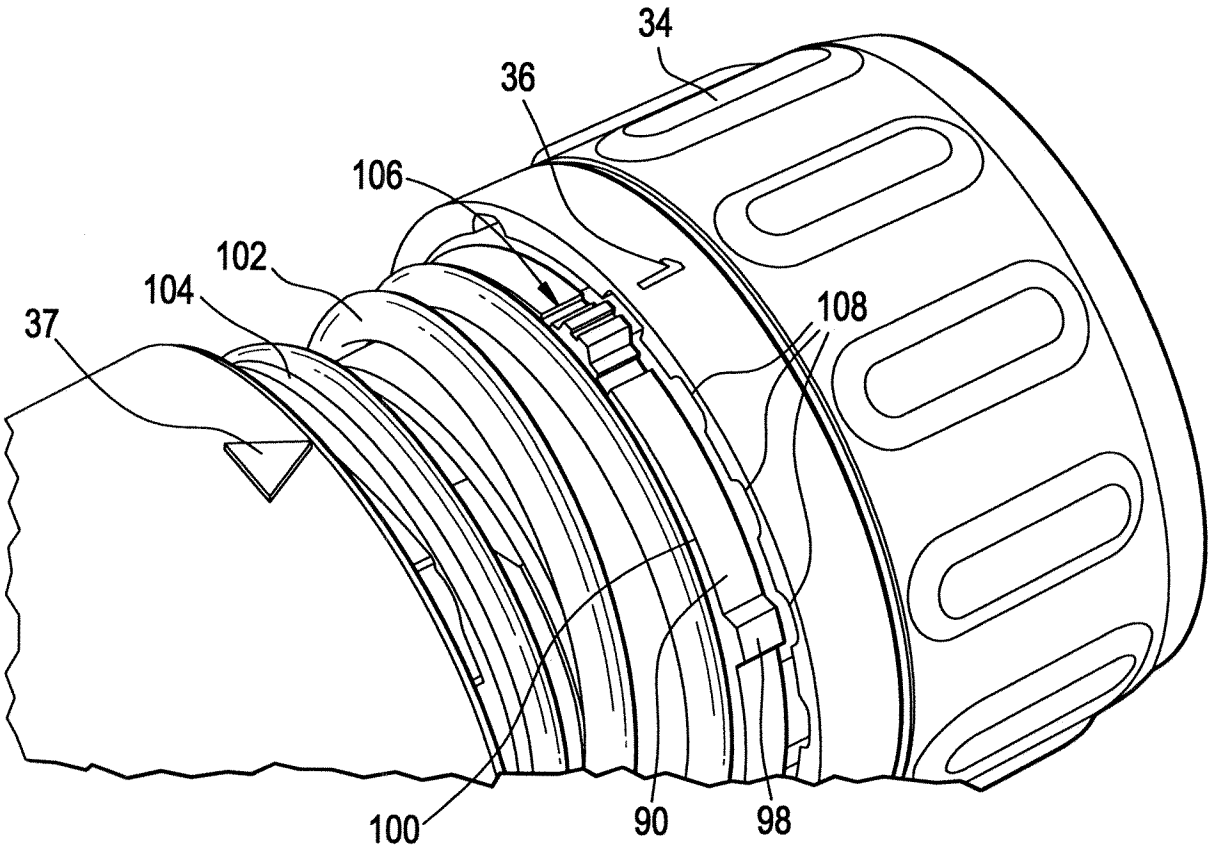
FIG. 11 is a partial perspective view of a power tool and clutch collar where the clutch collar is shown in a forward position to illustrate the clutch adjusting nut, clutch spring, and clutch washer mounted to the nose cone.

The clutch adjusting nut 90 includes a ridge 100. As shown in FIG. 10 a clutch spring 102 urges at one end against the ridge 100 and at the opposite end of the clutch spring 102, the clutch spring 102 urges against a clutch washer 104. The clutch spring 102 exerts a force on the ridge 100 of the clutch adjusting nut 90 which in turn urges the wire way 62 against the lens cover 40 and ultimately against the retaining ring 44. The force exerted by the clutch spring 102 keeps the light ring assembly 38 in axial position. As shown in FIG. 11 the clutch washer 104 urges against the nose cone 23.

FIG. 11 illustrates the clutch washer 104, clutch spring 102, and the clutch adjusting nut 90 mounted to the nose cone 23. The clutch collar 34 is shown in a forward axial position and not yet installed on the power tool 20 in order to expose the clutch washer 104, the clutch spring 102 and the clutch adjusting nut 90.

To provide ease in the assembly of the power tool 20, a tab 98 on the clutch adjusting nut 90 is scored with marks or notches 106 on one of the adjustment tabs 98. The scoring 106 provides a visual aid when assembling the collar 34 to properly align the clutch collar 34. The adjustment tab 98 on the clutch adjusting nut 90 is aligned with a desired notch 108 in the clutch collar 34. Once the desired notch 108 is aligned with the desired adjustment tab 98, the clutch collar 34 can be fitted onto the power tool 20. In some embodiments, the indicator 34 and the numbered scale 36 may also provide assistance in aligning the clutch collar 34 to provide proper assembly of the clutch collar 34 onto the nose cone 23.

FIG. 12 is a partial perspective view of the clutch collar 34 installed onto the guide 62. Other elements have been omitted from FIG. 12 in order to better show the interaction between the guide 62 and the clutch collar 34. The clutch collar 34, in some embodiments in accordance with the invention, is rotatable. The clutch collar 34 is rotatable on the power tool 20 in order to provide different torque and/or speed settings for the end effector 28. It may be desirable to limit the rotation of the clutch collar 34 in both directions to establish a maximum setting for turning the clutch collar clockwise and a maximum setting when turning the clutch collar counterclockwise as shown in FIG. 12. Making maximum and minimum settings is, in some embodiments, accomplished by using the collar stopping tab 82 which butts against the stop 110 on the clutch collar 34. The wall 112 on the stop 110 butts against a wall 114 on the collar stopping tab 82 to provide a limit to clutch collar 34 rotation in a clockwise direction as viewed in FIG. 12. The same stop 110 and collar stopping tab 82 provide a stop for rotating the clutch collar 34 in the opposite direction (i.e., counterclockwise as viewed in FIG. 12). This is accomplished when the clutch collar 34 is rotated so that the opposite wall 116 on the stop 110 butts against the opposite wall 118 on the tab 82.

FIG. 12 also illustrates additional notches 108 in the clutch collar 34 for providing detents when the clutch collar 34 is rotated to various settings with respect to the nose cone 23.

Figure 13:
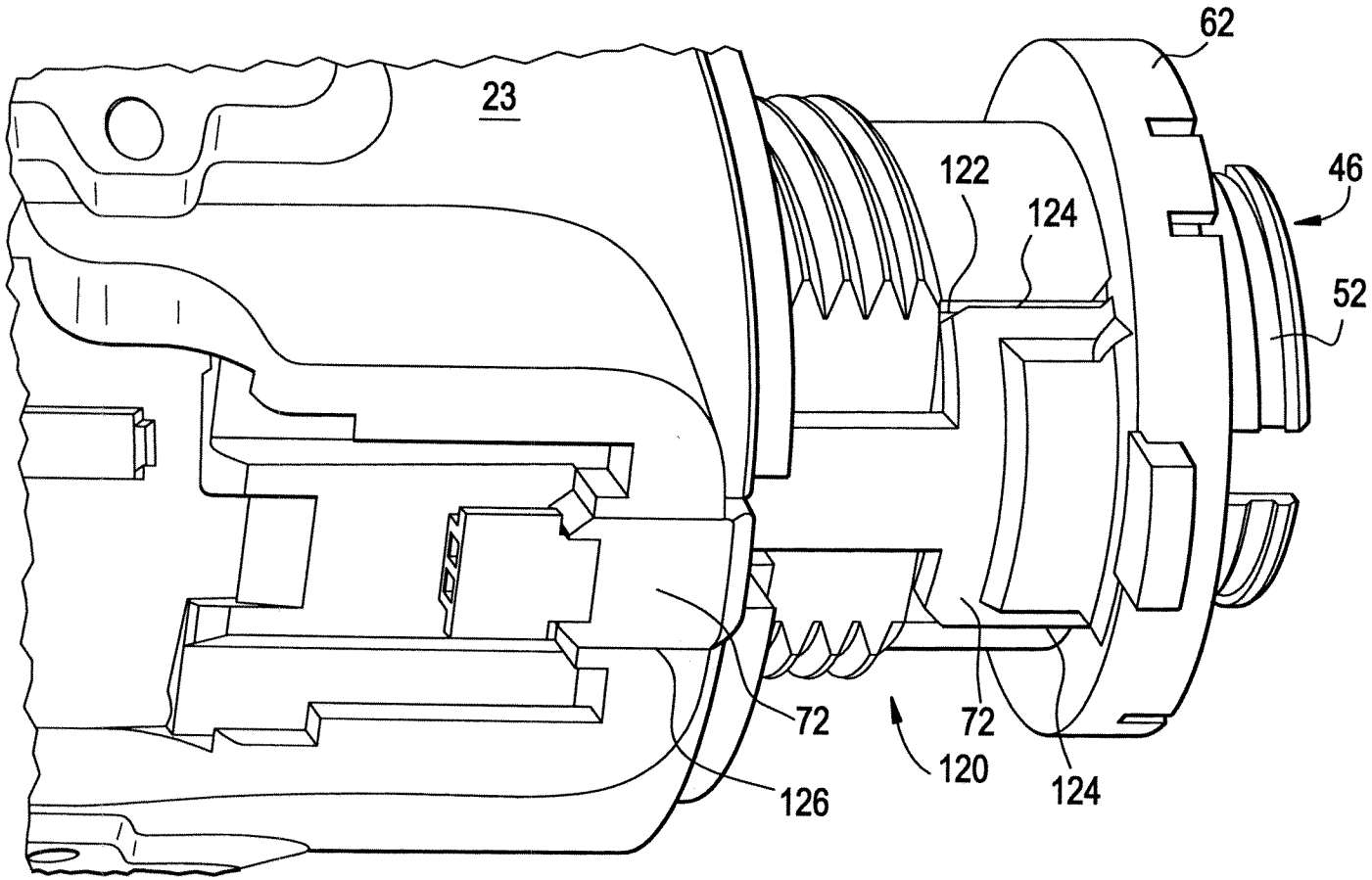
FIG. 13 is a partial perspective view of the wire guide mounted onto the nose cone.

FIG. 13 is a partial perspective view of the guide 62 mounted onto a stem portion 120 of the nose cone 23. A lock portion 124 of the guide 62 fits into a groove 122 of the stem portion 120 of the nose cone 23. The groove 122 is sized and dimensioned so that the lock portion 124 of the wire supporting portion 72 of the guide 62 fits within the groove 122 and locks the guide 62 to be angularly fixed with respect to the nose cone 23. The locks 124 located on the wire supporting portion 72 of the guide 62 are wider than the rest of the wire supporting portion 72 and aid in permitting the guide 62 to be securely seated in the groove 122 of the stem portion 120 of the nose cone 23.

A second groove 126 is in the nose cone 23 for allowing the wire supporting portion 72 of the guide 62 to fit within the groove 126 of the nose cone 23. The retainer 46 on the nose cone 23 and the groove 52 of the nose cone 23 are also shown forward of the guide 62. The above described features also help align the guide 62 with respect to the nose cone 23.

According to some embodiments, the retainer 46 is integral with the stem 120 and the nose cone 23. In other embodiments of the inventions, they may be separable parts.

Figure 14:
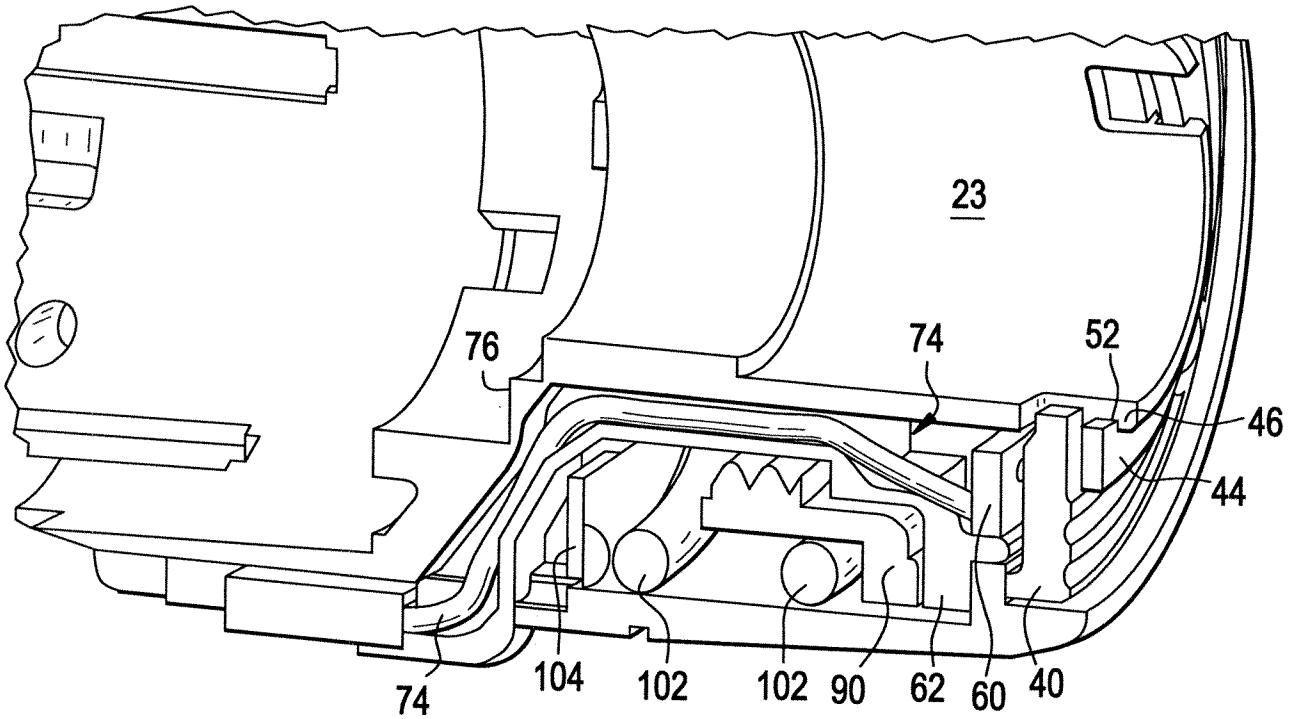
FIG. 14 is a partial cutaway perspective view of a nose cone as well as other elements mounted to the nose cone. The end effector and power transmission elements are removed for clarity.

FIG. 14 is a partial cutaway perspective view of the nose cone 23 and additional parts described below. FIG. 14 shows how the parts described herein are assembled together according to some embodiments of the invention. The transmission, spindle, and other parts associated with turning the end effector have been omitted to more clearly show the parts described herein. The retaining ring 44 is seated within the groove 52 of the retainer 46. The retaining ring 44 provides a limit of forward axial movement of the lens cover 40, the guide 62, and the clutch adjusting nut 90. The clutch spring 102 presses against the clutch washer 104 to urge the clutch adjusting nut 90 to urge the guide 62, PCB 60, and lens cover 40 against the retaining ring 44. The wires 76 are located in a channel 74 defined by the guide 62 and the nose cone 23. The wires 76 are protected from the spinning parts of the end effector mechanism.

Although an example of the light ring 38 is shown on a power driver 20, it will be appreciated that the light ring 38 can be used on other rotary power tools such as impact drivers, drills, hammer drills, routers.

Figure 15:
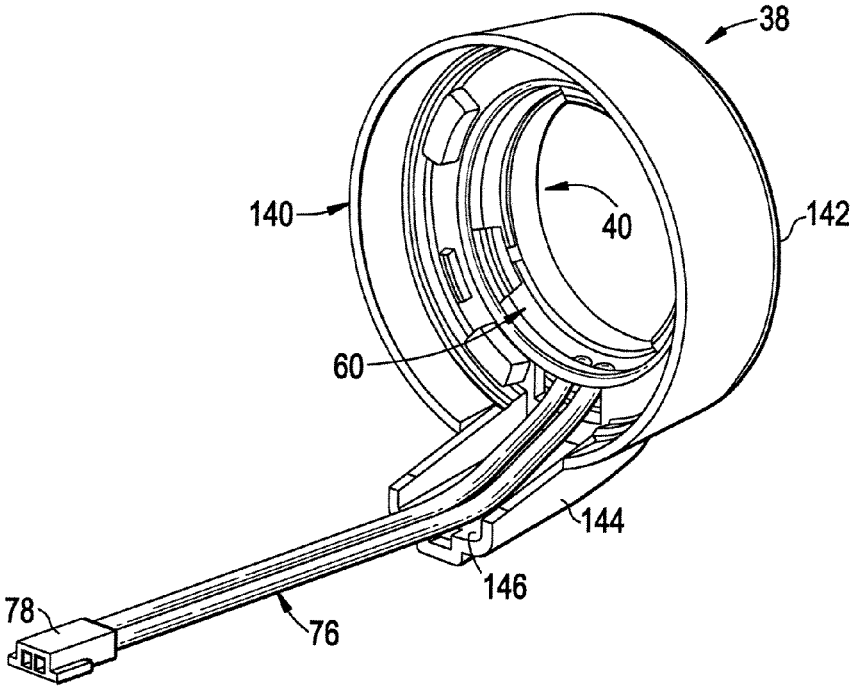
FIG. 15 is a perspective rear view of a holder in accordance with another embodiment of the invention.

An example embodiment in accordance with the invention where a light ring 38 is mounted on a different power tool than shown in the previous FIGS. is shown in FIGS. 15 through 19. FIG. 15 illustrates a perspective rear view of a holder 140 that is used on a power tool that is not equipped with a collar as described in the embodiments above. The holder 140 holds the light ring 38. The light ring 38 includes the PCB 60 similar to that described above. The PCB 60 and the holder 140 may include snap-in features 64 similar to that described above so that the PCB 60 snaps into and is secured in the holder 140.

A circular lens cover 40 may be mounted to the holder 140 in front of the PCB 60 similar to embodiments described above. The lens cover 40 may include snap-in elements that correspond with snap-in elements on the holder 140. In other embodiments in accordance with the invention, the lens 40 may be secured in place with a retaining ring system similar to that described above.

The holder 140 may attach to the nose cone 23 with snap-in elements located on both the holder 140 and the nose ring 23 similar to the snap-in features 64 described in the embodiments above. In other embodiments in accordance with the invention, the light ring holder 140 may be secured in place in a variety of ways including, but not limited to, a retaining ring system similar to the embodiments described above.

As shown in FIG. 15, the holder 140 includes a housing portion 142, a chin shroud 144, and a wire way portion 146. Wires 76 connect the PCB 60 (which contains light emitting elements similar to those described above) with a plug 78. In contrast to the wire way 62 described in the embodiments above, the holder 140 does not fully support the wires 76 along the full length of the wires 76 all the way to the plug 78. Rather, the wire way portion 146 stops at some point along the length of the wires 76, leaving the wires 76 and the plug 78 to be not supported by the holder 140.

Figure 16:
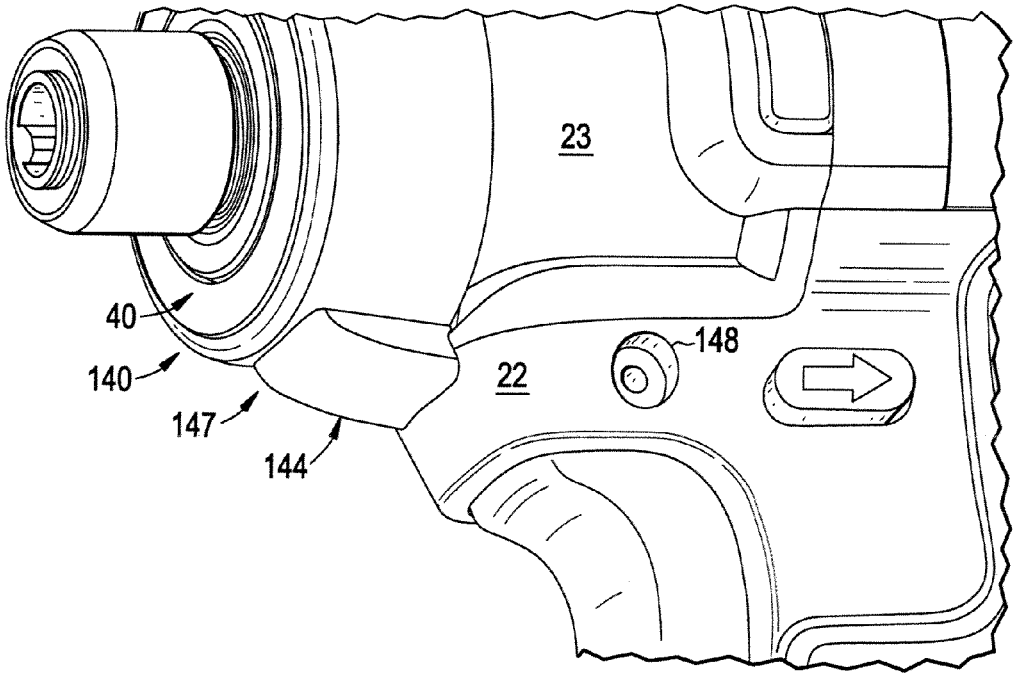
FIG. 16 is a partial perspective view of a power tool equipped with a holder similar to that shown in FIG. 15.

FIG. 16 is a partial perspective view of a power tool 147 that does not have a rotatable clutch collar but rather is equipped with the holder 140. The lens cover 40 is shown mounted in a recess in the holder 140. The holder 140 is mounted to the nose cone 23 which is supported by the housing 22. A fastener hole 148 is shown in the housing 22. The fastener hole 148 provides a place for a fastener such as a screw or bolt to connect the two halves of the clam shell type housing 22 together. While the fastener is not shown in FIG. 16, it will be appreciated that when the power tool 147 is fully constructed that a fastener will be located in the fastener hole 148 to connect the two halves of the clam shell housing 22 together. Other embodiments of the invention may connect the clamshells of the housing 22 in other ways. Some embodiments of the invention may include one piece housings or other types of housings than the clam shell housing shown in FIG. 16. The chin shroud 144 is located on the holder 140 and provides a housing for a portion of the wires 76 so that the wires 76 are not exposed outside of the power tool 147.

Figure 17:
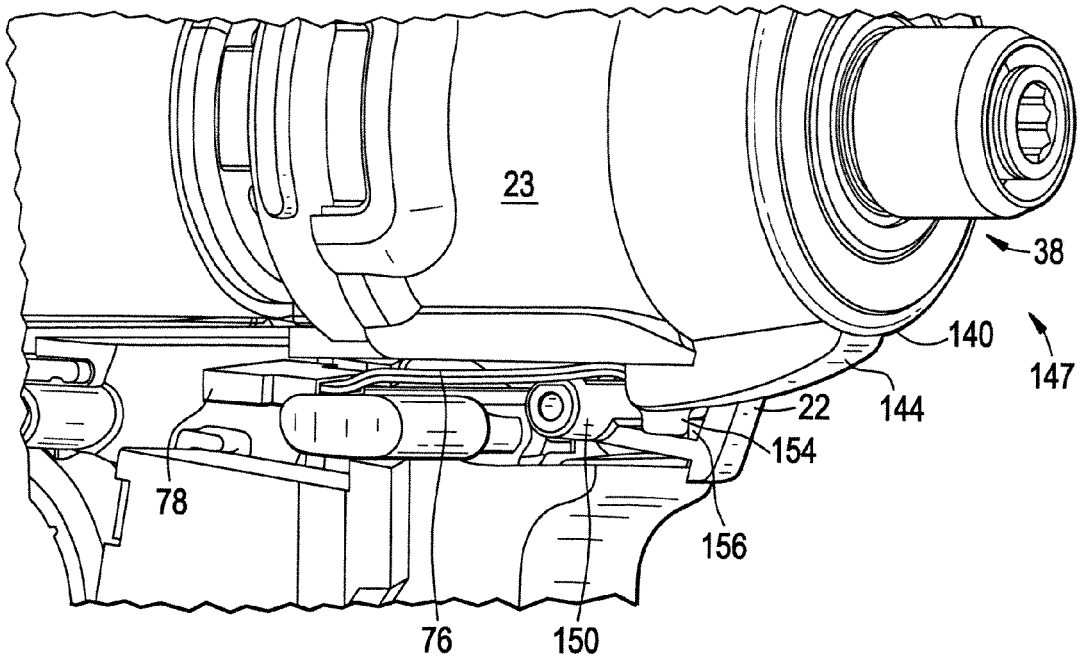
FIG. 17 is a partial perspective view with part of the housing removed of a power tool equipped with a holder similar to that shown in FIG. 15.
Figure 18:
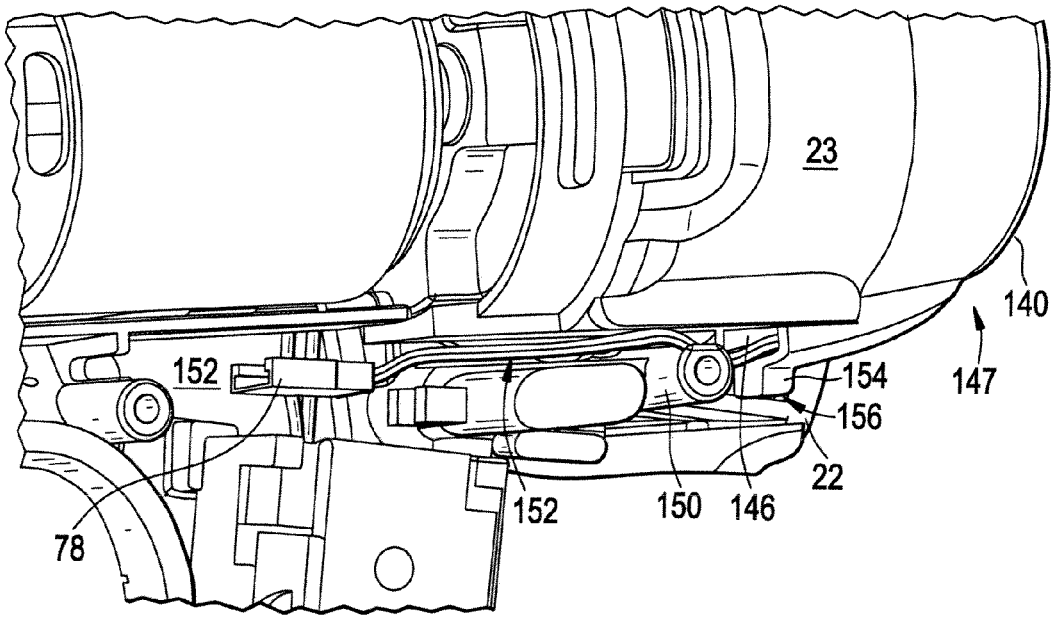
FIG. 18 is a partial perspective view of a power tool with part of the housing removed to expose interior components.

FIGS. 17 and 18 show the power tool 147 with part of the housing 22 removed. The housing 22 is a clam shell type housing and one of the clam shells is removed exposing the clam shell housing 22 located on the far side of the power tool 147. The holder 140 is shown mounted to the nose cone 23. A fastener hole tube 150 located in the fastener hole 148 is shown. The wires 76 are routed around the hole tube 150 and are located in the interior 152 of the housing 22. The wires 76 are terminated with a plug 78 also located in the interior 152 of the housing 22.

The interior 152 of the housing defines a space or pathway for the wires 76 and the plug 78. The chin shroud 144 defines a wire way portion 146 through which the wires 76 are strung. The chin shroud 144 also includes retaining structure 154 which is set in a retaining area 156 defined by the housing 22. When the two clam shells of the clam shell housing 22 are mounted together and fastened together with a fastener located in the fastener hole 148 and fastener hole tube 150, the retaining structure 154 on the chin shroud 144 is trapped in the retaining area 156 thereby holding the chin shroud 144 and holder 140 in place on the power tool 147. Operation of the light ring 38 is similar to that described in the embodiments above.

Figure 19:
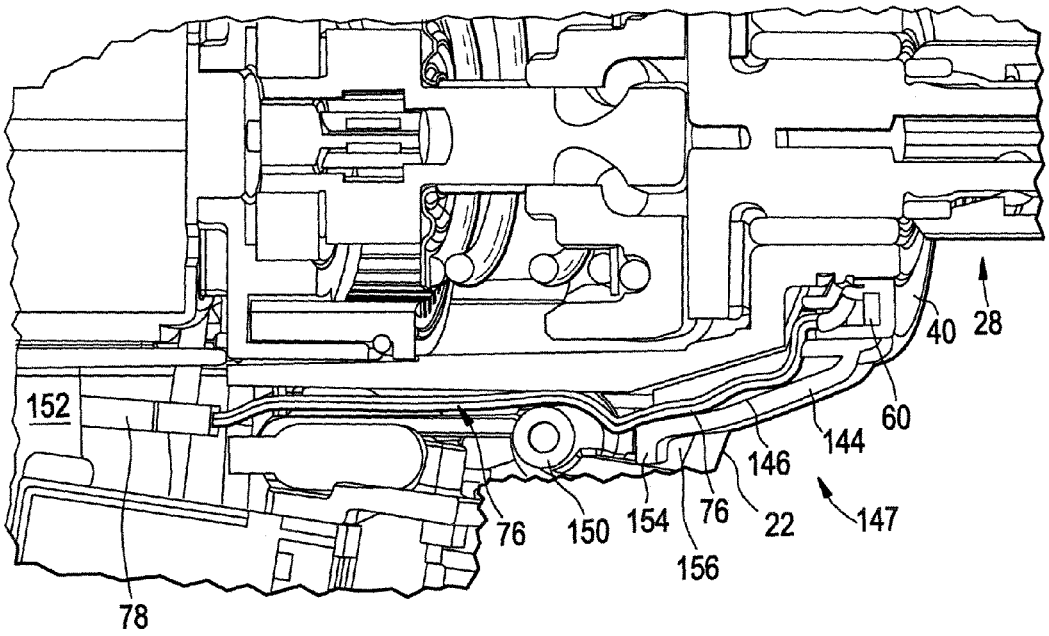
FIG. 19 is a partial perspective cut-away view of a power tool equipped with a holder similar to that shown in FIG. 15. The cut-away view illustrates some of the internal components of the power tool.

FIG. 19 is a partial perspective cut-away view showing the end effector 28 associated with the power tool 147 extending through the lens cover 40 located in front of the PCB 60. As described above, LEDs (not shown in FIG. 19) are located on the PCB 60 and configured to light the tool or workpiece being worked on by the power tool 147. The wires 76 provide power between the PCB 60 and a power source connected via the plug 78 to power source. The wires 76 are located in the wire way portion 146 of the chin shroud 144 and the interior 152 of the housing 22. The chin shroud 144 has the retaining structure 154 located in the retaining area 156 defined by the housing 22.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A power tool comprising:

a housing;

a tool holder rotatable with respect to the housing;

a collar rotatably coupled to the housing to select at least one of a clutch setting, a drive setting, a drill setting, and a hammer setting of the power tool, the collar having a rear end adjacent the housing and a front end adjacent the tool holder;

a light unit received within the collar, the light unit having a support member and at least one lighting element coupled to the support member and adjacent to the front end of the collar and adjacent to the tool holder, the lighting element configured to illuminate a workpiece machined by the power tool, wherein the light unit is non-rotatably fixed to the housing.

2. The power tool of claim 1, wherein the support member comprises a first rotational stop that engages with a second rotational stop on the housing to align the support member with the housing.

3. The power tool of claim 1, wherein the light unit further comprises a transparent member disposed in front of the at least one lighting element.

4. The power tool of claim 1, wherein at least a portion of the support member has a generally annular shape, and the at least one lighting element comprises a plurality of lighting elements arranged in a ring-shaped pattern.

5. The power tool of claim 1, wherein the light unit further comprises a guide extending from the support member and guiding a conductor to provide power to the at least one lighting element.

6. The power tool of claim 5, wherein the guide includes a channel and the conductor comprises at least one wire disposed in the channel.

7. A power tool comprising:

a housing;

a tool holder rotatable with respect to the housing;

an opaque collar rotatably coupled to the housing to adjust an operational setting of the power tool, the collar having a rear end adjacent the housing and a front end adjacent the tool holder;

a light unit received within the collar, the light unit having a support member and at least one lighting element coupled to the support member and adjacent the tool holder, the lighting element configured to illuminate a workpiece machined by the power tool, wherein the light unit is non-rotatably fixed to the housing.

8. The power tool of claim 7, wherein the support member comprises a first rotational stop that engages with a second rotational stop on the housing to align the support member with the housing.

9. The power tool of claim 7, wherein the light unit further comprises a transparent member disposed in front of the at least one lighting element.

10. The power tool of claim 7, wherein at least a portion of the support member has a generally annular shape, and the at least one lighting element comprises a plurality of lighting elements arranged in a ring-shaped pattern.

11. The power tool of claim 7, wherein the light unit further comprises a guide extending from the support member and guiding a conductor to provide power to the at least one lighting element.

12. The power tool of claim 7, wherein the collar is configured to select at least one of a clutch setting, a drive setting, a drill setting, and a hammer setting of the power tool.

13. A power tool comprising:

a housing;

a handle extending downward from the housing;

a switch coupled to the handle;

a chin region just above the switch and just below the housing;

an end effector rotatable with respect to the housing;

a collar coupled to the housing and having a rear end adjacent the housing and a front end adjacent the end effector;

a light unit received within the collar, the light unit having at least one lighting element configured to illuminate a workpiece machined by the power tool, and a guide that guides a conductor to the lighting element, through the chin region, to provide power to the lighting element.

14. The power tool of claim 13, wherein the light unit is rotationally fixed relative to the housing.

15. The power tool of claim 14, wherein the support comprises a first rotational stop that engages with a second rotational stop on the housing to align the support with the housing.

16. The power tool of claim 13, wherein the light unit further comprises a transparent member disposed in front of the at least one lighting element.

17. The power tool of claim 13, wherein at least a portion of the support member has a generally annular shape, and the at least one lighting element comprises a plurality of lighting elements arranged in a ring-shaped pattern.

18. The power tool of claim 13, wherein the collar is configured to select at least one of a clutch setting, a drive setting, a drill setting, and a hammer setting of the power tool.

* * * * *